US007758180B2

(12) United States Patent
Kawabata

(10) Patent No.: US 7,758,180 B2
(45) Date of Patent: Jul. 20, 2010

(54) IMAGE FORMING APPARATUS INCLUDING AN ELECTROSTATIC CONVEYANCE APPARATUS CAPABLE OF STABLY CONVEYING A RECORDING MEDIUM

(75) Inventor: Kenichi Kawabata, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 490 days.

(21) Appl. No.: 11/606,420

(22) Filed: Nov. 29, 2006

(65) Prior Publication Data

US 2007/0120936 A1 May 31, 2007

(30) Foreign Application Priority Data

Nov. 29, 2005 (JP) ..... 2005-343112

(51) Int. Cl.
*B41J 2/01* (2006.01)

(52) U.S. Cl. ..... 347/104

(58) Field of Classification Search ..... 198/499; 347/16, 101, 104; 400/635
See application file for complete search history.

(56) References Cited

U.S. PATENT DOCUMENTS

2001/0054538 A1* 12/2001 Finger et al. ..... 198/499
2005/0191081 A1* 9/2005 Muraishi et al. ..... 399/100
2005/0253920 A1* 11/2005 Yoshimizu ..... 347/217
2005/0270355 A1* 12/2005 Sootome et al. ..... 347/104

FOREIGN PATENT DOCUMENTS

| | | |
|---|---|---|
| JP | 7-36290 | 2/1995 |
| JP | 2000-246981 | 9/2000 |
| JP | 2004-175494 | 6/2004 |
| JP | 2004-217373 | 8/2004 |
| JP | 2005-313348 | 11/2005 |
| WO | WO 2005102704 A1 * | 11/2005 |

OTHER PUBLICATIONS

Apr. 6, 2010 Japanese official action in connection with a counterpart Japanese patent application.

* cited by examiner

*Primary Examiner*—Matthew Luu
*Assistant Examiner*—Kendrick X Liu
(74) *Attorney, Agent, or Firm*—Cooper & Dunham LLP

(57) ABSTRACT

An image forming apparatus, which uses an electrostatic force to hold a recording medium during conveyance, includes a rotary belt, an image forming mechanism, a driving mechanism, a contact member in contact with the rotary belt, a charging mechanism and a controller. The controller may cause the contact member to be held in contact with the rotary belt, may cause the bias voltage to vary so as to reduce the electrostatic force during a time other than the image forming operation by the image forming mechanism, and may cause the driving mechanism to drive the rotary belt when the contact member is held in contact with the rotary belt.

19 Claims, 14 Drawing Sheets

IMAGE FORMING APPARATUS INCLUDING AN ELECTROSTATIC CONVEYANCE APPARATUS CAPABLE OF STABLY CONVEYING A RECORDING MEDIUM

TECHNICAL FIELD

The present disclosure generally relates to an electrostatic conveyance apparatus and an image forming apparatus using the same, and more particularly to an electrostatic conveyance apparatus capable of stably conveying a recording medium for an extended period of time, and an image forming apparatus provided with the electrostatic conveyance apparatus.

DISCUSSION OF THE BACKGROUND

As image forming apparatuses such as a printer, facsimile, copier and multifunctional machine including functions of printer, facsimile and copier, an ink-jet recording medium, an inkjet recording apparatus is known. The inkjet recording apparatus, for example, utilizes a recording head or an image forming mechanism equipped with a liquid droplet ejecting head for forcing ink droplets of recording liquid (hereinafter referred to as ink droplets) out to adhere the ink droplets to a sheet while conveying the sheet. Thereby, image formation is carried out. The sheet herein not only refers to paper, but also refers to a recording medium, a transfer material, a recording sheet and the like. The image formation herein refers to recording, printing and imaging.

In a case where an image is formed by an inkjet recording method, the ink is adhered to the sheet. Consequently, the moisture contained in the ink causes the sheet to deform. This phenomenon is referred to as cockling. Due to cockling, the sheet may ripple so that the position of a nozzle of the recording head and the sheet surface varies from place to place. In a case where the level of cockling is high, in a worst case, the sheet touches the nozzle surface of the head, thereby contaminating the nozzle surface of the head and the sheet itself. As a result, the image quality deteriorates, and a misalignment of the ink droplet landing position may occur due to an effect of cockling.

In view of the above, in a related art inkjet recording apparatus, according to Japanese Patent Laid-Open Application Publication No. JP2004-175494, for example, an endless charging belt to maintain the flatness of the sheet is provided. The charging belt surface is charged so as to electrostatically suction the sheet. By forcing the charging belt to circulate in this state and to convey the sheet, the sheet is prevented from separating from the charging belt. Accordingly, high flatness is maintained.

According to Japanese Patent Laid-Open Application Publication No. JP2000-246981, since cockling and curling of printing sheet affect printing image, in a printing sheet conveyance apparatus for carrying out a printing operation in which printing sheet is electrostatically suctioned by an electrostatic suction member at a printing position to print on the printing sheet and for moving printing sheet, a mechanism for switching, depending on a type of printing sheet used, between a state where the printing sheet is suctioned by the electrostatic suction member and a state where the printing sheet is not suctioned by the electrostatic suction member is proposed.

Furthermore, in Japanese Patent Laid-Open Application Publication No. JP2000-246981, a mechanism for causing a cleaning mechanism to touch or not to touch the image receiving surface of the electrostatic suction member is provided.

During the process of printing at the time of continuous printing sheet feeding, cleaning is carried out on the image receiving surface of the electrostatic suction member by the cleaning mechanism.

As described above, in the electrostatic conveyance apparatus for suction of a sheet-type material such as paper to the conveyance belt by electrostatic suction force in order to convey the sheet, when the conveyance belt is charged by the charging mechanism, charged products are generated on the surface of the conveyance belt. Consequently, there is a concern that suction may be reduced, as the number of conveying sheet increases.

In this case, however, as described in Japanese Patent Laid-Open Application Publication No. JP2000-246981, it is not adequate enough to recover the reduction of suction caused by the charged products, when foreign substances such as paper dust adhered to the surface of the conveyance belt is removed by the cleaning mechanism. Furthermore, there is a concern that while the cleaning mechanism removes the foreign substances charging the conveyance belt, the charged compounds may be generated.

SUMMARY

In an aspect of this disclosure, there is provided an image forming apparatus including an electrostatic conveyance apparatus capable of stably conveying a recording medium.

In one exemplary embodiment, a novel image forming apparatus which uses an electrostatic force to flatly hold a recording medium during conveyance, includes a rotary belt for carrying a recording medium, an image forming mechanism, a driving mechanism, a contact member, a charging mechanism, and a controller. The image forming mechanism performs an image forming operation to form an image on the recording medium carried by the rotary belt. The driving mechanism may drives the rotary belt. The contact member is movably held near the rotary belt. The charging mechanism applies a charging voltage superimposed on a bias voltage to the rotary belt. The controller causes the contact member to be held in contact with the rotary belt, causes the bias voltage to vary so as to reduce the electrostatic force, and causes the driving mechanism to drive the rotary belt when the contact member is held in contact with the rotary belt, and the bias voltage is reduced. Thus, the bias voltage is varied so as to reduce the electrostatic force during a time other than the image forming operation by the image forming mechanism.

In one exemplary embodiment of the above-mentioned image forming apparatus, the controller reduces the bias voltage of the charging mechanism so as not to generate the electrostatic force to suction the recording medium onto the rotary belt. In such a case, the bias voltage may be of an alternating voltage, and the controller may shorten a charge cycle length so as not to generate the electrostatic force to suction the recording medium onto the rotary belt. The controller may turn off the bias voltage of the charging mechanism.

In one exemplary embodiment of the above-mentioned image forming apparatus, the contact member may include a PET film. In such a case, the contact member may be held in contact with the rotary belt in a direction counter to a moving direction of the rotary belt, and may have a brush-like form. The image forming apparatus may further include a discharging brush for discharging the rotary belt. The contact member may be positioned further upstream relative to the discharging brush in a moving direction of the rotary belt.

In one exemplary embodiment of the above-mentioned image forming apparatus, the controller may vary the time period during which the rotary belt is driven by the driving mechanism, when the contact member is held in contact with the rotary belt and the bias voltage is varied so as to reduce the electrostatic force during the time other than the image forming operation by the image forming mechanism. In such a case, the controller may vary the time period during which the rotary belt is driven by the driving mechanism, based on a number of the recording medium carried by the rotary belt. The controller may vary the time period during which the rotary belt is driven by the driving mechanism, based on a number of the recording medium carried by the rotary belt during one job of the image forming operation. The controller may also vary the time period during which the rotary belt is driven by the driving mechanism, based on an accumulated number of the recording medium carried by the rotary belt.

In one exemplary embodiment, a novel image forming apparatus may further include a measuring mechanism for measuring a resistance of a surface of the rotary belt. The controller may cause the contact member to be held in contact with the rotary belt, cause the bias voltage to vary so as to reduce the electrostatic force during a time other than the image forming operation by the image forming mechanism, and cause the driving mechanism to drive the rotary belt when the contact member is held in contact with the rotary belt. The bias voltage is varied so as to reduce the electrostatic force during the time other than the image forming operation by the image forming mechanism, based on the resistance of the surface of the rotary belt measured by the measuring mechanism.

In one exemplary embodiment of the above-mentioned image forming apparatus, the controller may cause the contact member to be held in contact with the rotary belt, cause the bias voltage to vary so as to reduce the electrostatic force during a time other than the image forming operation by the image forming mechanism, and cause the driving mechanism to drive the rotary belt when the contact member is held in contact with the rotary belt. The bias voltage is varied so as to reduce the electrostatic force during the time other than the image forming operation by the image forming mechanism, after the image forming mechanism completes a job of the image forming operation.

In one exemplary embodiment of the above-mentioned image forming apparatus, the controller may cause the contact member to be held in contact with the rotary belt, cause the bias voltage to vary so as to reduce the electrostatic force during a time other than the image forming operation by the image forming mechanism, and cause the driving mechanism to drive the rotary belt when the contact member is held in contact with the rotary belt. The bias voltage is varied so as to reduce the electrostatic force during the time other than the image forming operation by the image forming mechanism, during a time period between two adjacent cycles of the image forming operations.

In one exemplary embodiment of the above-mentioned image forming apparatus, the controller may cause the contact member to be held in contact with the rotary belt, cause the bias voltage to vary so as to reduce the electrostatic force during the time other than the image forming operation by the image forming mechanism, and cause the driving mechanism to drive the rotary belt when the contact member is held in contact with the rotary belt. The bias voltage is varied so as to reduce the electrostatic force during a time other than the image forming operation by the image forming mechanism, in a case where the controller performs a recovering operation relative to a defective condition of the image forming mechanism.

In another exemplary embodiment, a novel sheet conveying apparatus which uses an electrostatic force to flatly hold a recording medium during conveyance and is employed in an image forming apparatus may include a rotary belt, a driving mechanism, a contact member, a charging mechanism and a controller. The rotary belt carries a recording medium. The driving mechanism drives the rotary belt. The contact member is movably held near the rotary belt. The charging mechanism applies a charging voltage superimposed on a bias voltage to the rotary belt. The controller causes the contact member to be held in contact with the rotary belt, causes the bias voltage to vary so as to reduce the electrostatic force, and causes the driving mechanism to drive the rotary belt when the contact member is held in contact with the rotary belt, and the bias voltage is reduced.

BRIEF DESCRIPTION OF THE DRAWINGS

A more complete appreciation of the subject matter of the disclosure and many of the attendant advantages thereof may be better understood by reference to the following detailed description of exemplary embodiments when considered in connection with the accompanying drawings, wherein.

DETAILED DESCRIPTION OF EXEMPLARY EMBODIMENTS

Figure 1:
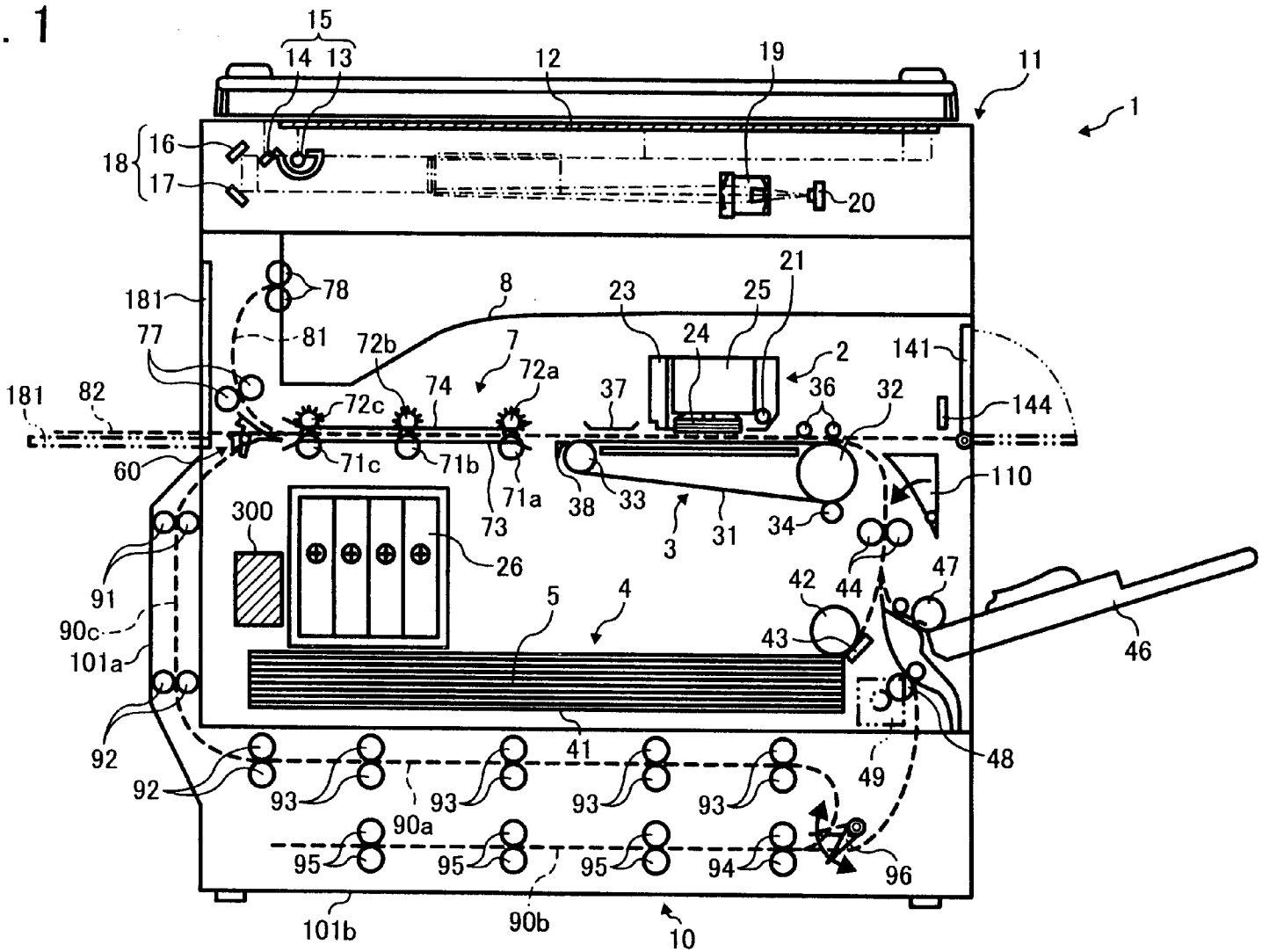
FIG. 1 is a schematic diagram illustrating an image forming apparatus according to an exemplary embodiment of the present disclosure.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. For the sake of simplicity of drawings and descriptions, the same reference numerals are used for materials and constituent parts having the same functions, and descriptions thereof will be omitted unless otherwise stated. Exemplary embodiments of the present disclosure are now explained below with reference to the accompanying drawings. In the later described comparative example, exemplary embodiment, and alternative example, the same reference numerals will be used for constituent elements such as parts and materials having the same functions, and the descriptions thereof will be omitted.

Figure 2:
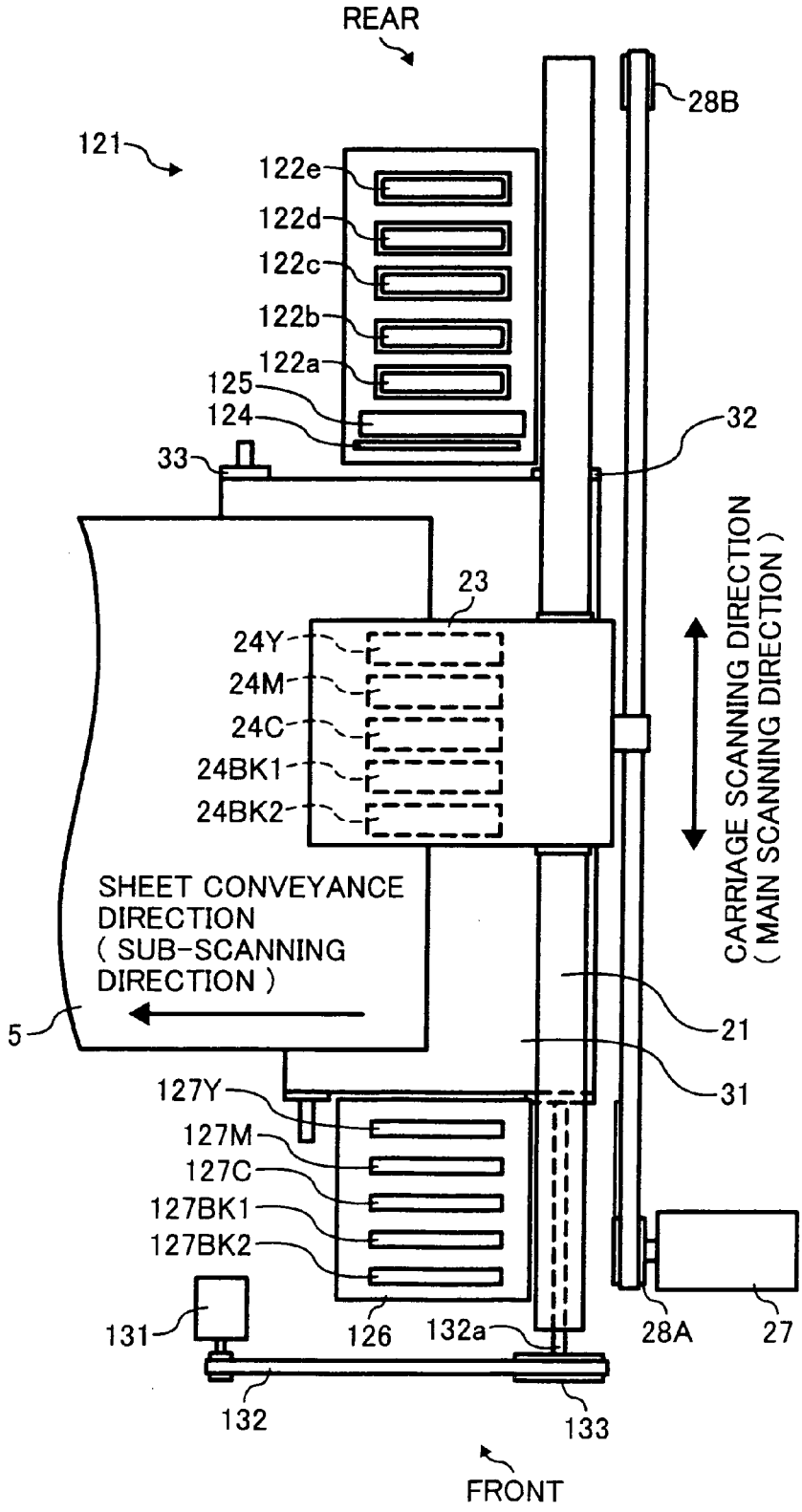
FIG. 2 is a schematic diagram of an image forming unit of the image forming apparatus shown FIG. 1.
Figure 3:
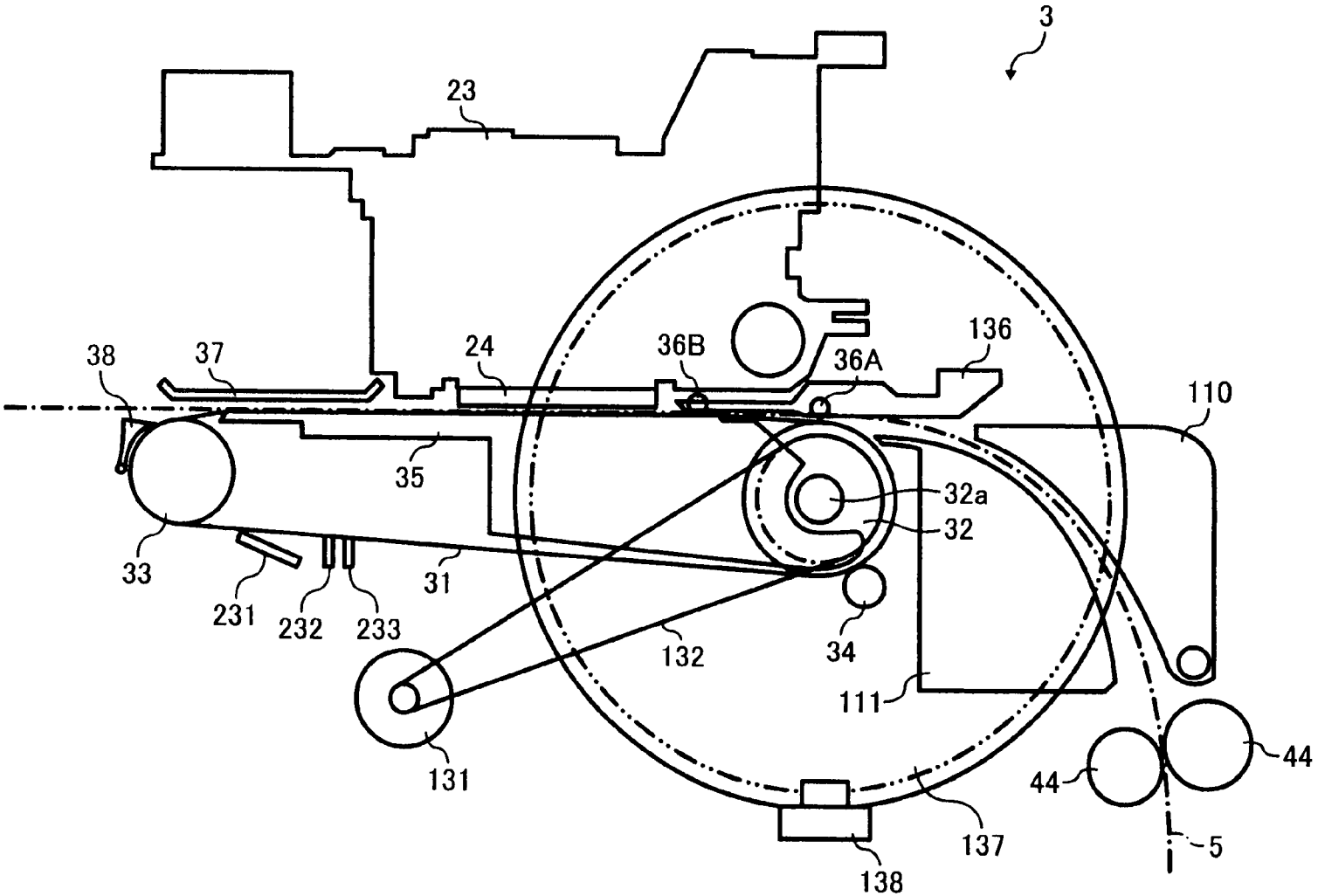
FIG. 3 is a cross-sectional view of a subscanning conveyance unit of the image forming apparatus shown in FIG. 1.
Figure 4:
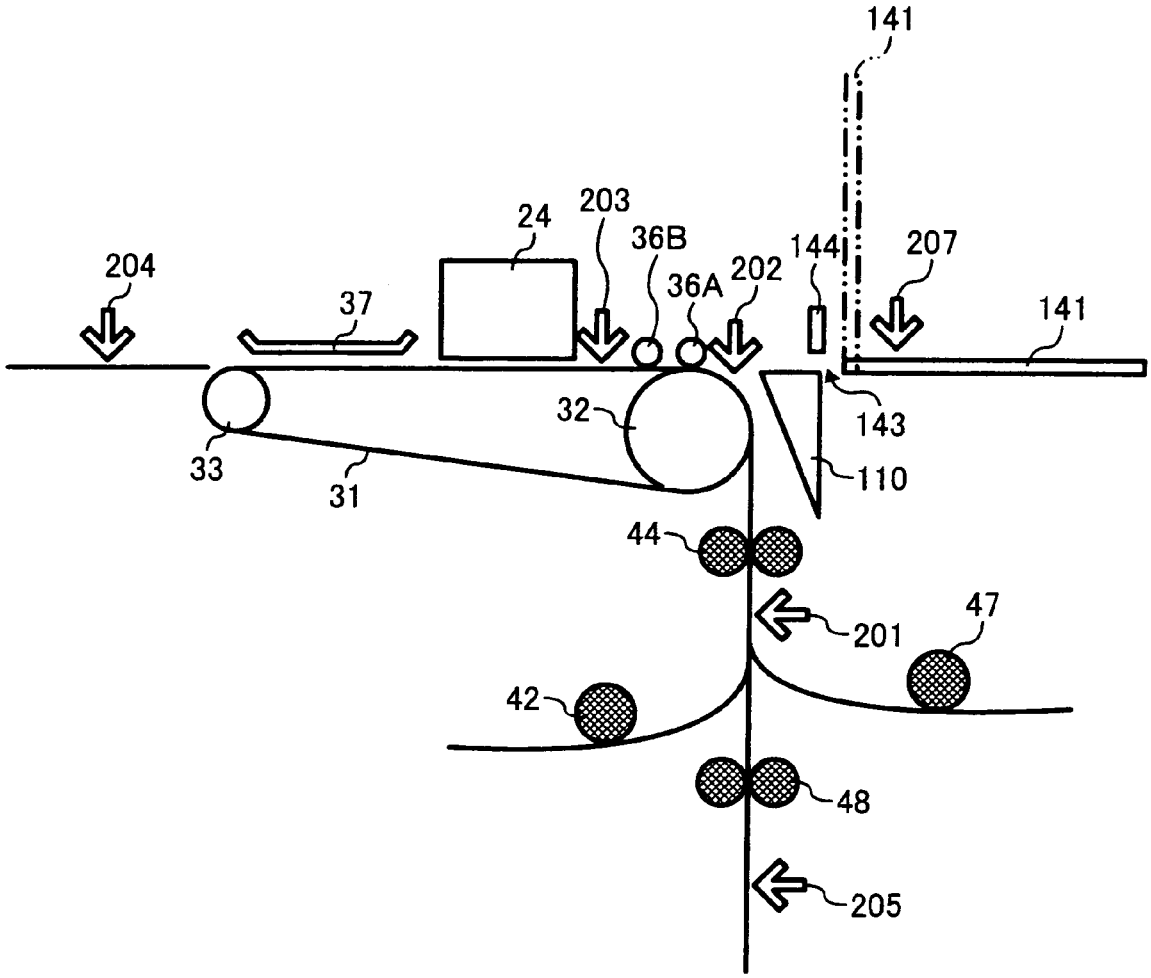
FIG. 4 is a schematic diagram illustrating a sheet conveyance path of a conveyance belt of the image forming apparatus shown in FIG. 1.

Referring now to the drawings, wherein like reference numerals designate identical or corresponding parts throughout the several views, exemplary embodiments of the present disclosure will be explained below with reference to the drawings. FIGS. 1 through 5 illustrate an example of an image forming apparatus including a sheet conveyance apparatus, according to one exemplary embodiment of the present disclosure. FIG. 1 is a schematic diagram illustrating an overall structure of the image forming apparatus. FIG. 2 is a plan view illustrating an image forming unit and a subscanning conveyance unit. FIG. 3 is a side view illustrating the subscanning conveyance unit, a part of which is illustrated in a transparent manner. FIG. 4 illustrates a frame format of a sheet conveyance path relative to a conveyance belt.

In a main body or a housing 1 of the image forming apparatus, an image forming unit (mechanism) 2, a subscanning conveyance unit (mechanism) 3, a sheet feeding unit (mechanism) 4, a sheet ejecting unit 7, a catch tray 8, a duplex unit 10 and so forth are provided. The image forming mechanism 2 forms an image while conveying the sheet. The subscanning conveyance mechanism 3 conveys the sheet. The sheet feeding unit 4 is disposed at the bottom of the housing 1 and feeds a sheet 5 one sheet at a time. The subscanning conveyance unit 3 conveys the sheet 5 at a position relative to the image forming unit 2. After ink droplets are ejected on the sheet 5 to form or record a necessary image in the image forming unit 2, in a case of single-sided printing, the sheet 5 is ejected on the catch tray 8 formed on an upper surface of the housing 1 through the sheet ejecting unit 7. In a case of double-sided printing, after ink droplets are ejected onto the sheet 5 to form or record a necessary image in the image forming unit 2, the sheet 5 is sent, on the way to the sheet ejecting unit 7, to the duplex unit 10 disposed at the bottom of the housing 1. The sheet 5 is again supplied to the subscanning conveyance unit 3 by means of the switchback conveyance to form an image on both sides. After the image is formed on both sides, the sheet 5 is ejected on the catch tray 8.

In the image forming apparatus, an image reading unit or a scanner 11 for reading an image is provided above the catch tray 8 on the upper side of the housing 1 as an input system for image data (print data) created in the image forming unit 2. The image reading unit 11 includes an optical scanning system 15 (equipped with a light source 13 and a mirror 14), an optical scanning system 18 (equipped with mirrors 16 and 17), a contact glass 12, a lens 19, and an image reading device 20. The optical scanning system 15 including the light source 13 and the mirror 14, and the optical scanning system 18 including the mirrors 16 and 17 move so as to read an image on an original document placed on the contact glass 12. The scanned document image is then read as image signals by the image reading device 20 disposed on the back of the lens 19. Subsequently, the read image signals are digitalized and are subjected to image processing. The print data, in which the image processing is performed, becomes printable.

Furthermore, the image forming apparatus, as the input system for the image data (print data) formed in the image forming unit 2, may receive the print data or the like through a cable or a network. The print data or the like includes image data from a host side such as an information processing apparatus (for example, an external personal computer or the like), an image reading apparatus such as an image scanner, an imaging apparatus such as a digital camera. The image forming apparatus may process the received print data and may print out.

As shown in FIG. 2, the image forming unit 2 in the image forming apparatus movably holds a carriage 23 in a cantileverly manner by a guide rod 21 and a guide rail (not shown). A main scanning motor 27 causes the carriage 23 to move and scan in a main scanning direction through a timing belt 29 spanned between a driving pulley 28A and a driven pulley 28B.

Recording heads 24 are mounted on the carriage 23. The recording heads 24 are formed of liquid droplet ejecting heads for ejecting droplets of each color and have a shuttle-type head in which the carriage 23 moves in the main scanning direction, and the subscanning conveyance unit 3 sends the sheet 5 in the sheet conveyance direction or the subscanning direction ejecting ink droplets from the recording heads 24 so as to form an image. However, a line-type head may be used.

The recording heads 24 are formed of two ink droplet ejecting heads 24BK1 and 24BK2 for ejecting black ink, and three ink droplet ejecting heads 24C, 24M and 24Y for ejecting three different colors of cyan (C), magenta (M) and yellow (Y), respectively. Total of five ink ejecting heads are provided. Unless otherwise specified, the ink droplet ejecting heads are hereinafter referred to as the recording heads 24. Each color of ink is supplied from a corresponding sub-tank mounted to the carriage 23.

As shown in FIG. 1, ink cartridges 26 for each color are attachably/detachably mounted to a cartridge mounting portion from the front of the housing 1. The ink cartridges 26 are of recording liquid cartridges which store three different colors of ink, cyan (C), magenta (M) and yellow (Y), respectively, and supply each color of ink to the sub-tank 25 of respective colors. The single ink cartridge 26 supplies black ink to two sub-tanks 25.

Different types of recording heads such as piezoelectric, thermal and electrostatic types may be used for the recording heads 24. The piezoelectric type recording head uses a piezoelectric element as a pressure generating mechanism or an actuator mechanism to press the ink in an ink channel or a pressure generating chamber so as to deform a diaphragm forming a wall of the ink channel. Consequently, the volume of ink channel is changed, thereby ejecting ink droplets. The thermal type recording head uses a heating element to heat the ink in the ink channel so that a bubble is generated. The pressure caused by the generation of the bubble propels the ink droplets out. In the electrostatic type recording head, the diaphragm which forms the wall of the ink channel is disposed across from an electrode so that an electrostatic force is generated between the diaphragm and the electrode. Consequently, the diaphragm is deformed, thereby changing the volume of the ink channel and ejecting ink droplets.

As shown in FIG. 2, a nozzle condition maintenance/recovery device 121 which maintains and recovers the nozzle condition of the recording heads 24 is disposed in a non-print region on one side of the carriage 23 in the scanning direction. The nozzle condition maintenance/recovery device 121 includes five moisturizing caps 122*a*, 122*b*, 122*c*, 122*d* and 122*e* to cover each of the nozzle surfaces of five recording heads 24. Unless otherwise specified, the moisturizing caps are hereinafter referred to as the moisturizing caps 122. The nozzle condition maintenance/recovery device 121 further includes one suction cap 123, a wiping blade 124 for wiping the nozzle surfaces of the recording heads 24 and a waste droplet receiving member 125 for carrying out ejection or so-called "empty ejection" of ink droplets which are not used for recording or image formation.

Furthermore, as shown in FIG. 2, a waste droplet receiving member 126 for carrying out ejection or so-called "empty ejection" of ink droplets, which are not used for recording or image formation from the recording heads 24, is provided in the non-print region on the other side of the carriage 23 in the scanning direction. Five openings 127BK1, 127BK2, 127C, 127M and 127Y are formed on the waste droplet receiving member 126, each corresponding to the recording heads. Unless otherwise specified, the openings are hereinafter referred to as the openings 127.

As shown in FIG. 3, the subscanning conveyance unit 3 includes a conveyance roller 32, an endless conveyance belt 31, a charging roller 34, a guide member 35, a pressing member 36A, a pressing roller 36B, a guide plate 37 and a separation claw 38. The conveyance roller 32 serving as a drive roller shifts the conveyance direction of the sheet 5 fed from the downward side by approximately 90 degrees so as to convey the sheet 5 facing the image forming unit 2. The endless conveyance belt 31 is laid across a driven roller 33 serving as a tension roller. The charging roller 34 is a charging mechanism to which high voltage (alternating voltage) is applied from a high voltage power source so as to charge the surface of the conveyance belt 31. The guide member 35 guides the conveyance belt 31 in the area opposite to the image forming unit 2. The pressing member 36A is rotatably held by a holding member 136 and presses the sheet 5 against the conveyance belt 31 at a position opposite to the conveyance roller 32. The pressing roller 36B presses the sheet 5 against the conveyance belt 31 before the recording heads 24. The guide plate 37 holds the upper surface of the sheet 5, on which an image is formed by the image forming unit 2. The separation claw 38 separates the sheet 5, on which the image is formed, from the conveyance belt 31.

Figure 5:
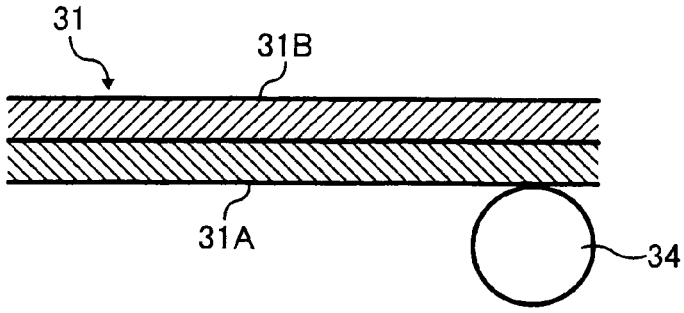
FIG. 5 is a cross-sectional view of an example of the conveyance belt.

The conveyance belt 31 of the subscanning conveyance unit 3 is structured such that when the conveyance roller 32 is rotated via a timing belt 132 and a timing roller 133 by a subscanning motor 131 which uses a DC brushless motor, the conveyance belt 31 rotates in the sheet conveying direction or the subscanning direction shown in FIG. 2. As shown in FIG. 5, the conveyance belt 31 has, for example, a double layer structure with a front surface layer 31A serving as a sheet suction surface formed of pure resin material, not applied with resistance control, for example, ETFE pure material, and a rear surface (mid-resistance layer or ground layer) 31B of the same material as that of the front surface layer 31A, but applied with resistance control by carbon. However, the conveyance belt 31 may have a single layer structure or may be formed of three or more layers.

Furthermore, between the driven roller 33 and the charging roller 34 there are provided in a moving direction of the conveyance belt 31 from an upstream side a Mylar (registered trademark) 231 made from a PET film serving as a cleaning mechanism for removing paper dust or the like adhered to the surface of the conveyance belt 31 while contacting the surface thereof, a cleaning brush 232 which also comes into contact with the surface of the conveyance belt 31, and a discharging brush 233 which removes the electric charges on the surface of the conveyance belt 31.

A rotary encoder is formed of a high-resolution codewheel 137 and an encoder sensor 138. The high-resolution codewheel 137 is mounted on a shaft 32*a* of the conveyance roller 32. The encoder sensor 138 is formed of a transmission photosensor which detects a slit 137*a* formed on the codewheel 137.

The sheet feeding unit 4 is equipped with a sheet feed cassette 41, a sheet feed roller 42, a friction pad 43, and a pair of registration rollers 44. The sheet feed cassette 41 is removably inserted to the apparatus main body 1 from the front and carries a number of sheets 5. The sheet feed roller 42 and the friction pad 43 separate the sheets 5 stored in the sheet feed cassette 41 one by one, and send the sheet 5. The pair of registration rollers 44 register the supplied sheet 5.

Furthermore, the sheet feeding unit 4 includes a manual feed tray 46, a manual feed roller 47 and a conveyance roller 48. The manual feed tray 46 carries a number of sheets 5. The manual feed roller 47 separates and feeds the sheets 5 one by one from the manual feed tray 46. The conveyance roller 48 vertically conveys the sheets 5 supplied from an optional sheet feed cassette mounted at the bottom of the apparatus main body 1 or from the later-described duplex unit 10. The member such as the sheet feed roller 42, the registration rollers 44, the manual feed roller 47 and the conveyance roller 48 used for feeding the sheet 5 to the sub-scanning conveyance unit 3 is rotationally driven by a sheet feeding motor or a driving mechanism 49 formed of an HB-type stepping motor, through a not-shown magnetic clutch.

The sheet ejecting unit 7 includes three conveyance rollers 71*a*, 71*b* and 71*c*; three spurs 72*a*, 72*b* and 72*c* facing the conveyance rollers 71; a lower guide member 73 and an upper guide member 74; a pair of sheet reversing rollers 77; and a pair of reverse sheet ejecting rollers 78. Unless otherwise specified, the conveyance rollers 71*a*, 71*b* and 71*c* are hereinafter referred to as the conveyance rollers 71. Unless otherwise specified, the spurs 72*a*, 72*b* and 72*c* are hereinafter referred to as the spurs 72. The conveyance rollers 71 conveys the sheet 5 separated by the separation claw 38 of the subscanning conveyance unit 3. The lower guide member 73 and the upper guide member 74 guide the sheet 5 which is carried in a space between the conveyance rollers 71 and the spurs 72. The pair of sheet reversing rollers 77 and a pair of reverse sheet ejecting rollers 78 reverse the sheet 5 transferred from a space between the lower guide member 73 and the upper guide member 74 through a reverse sheet ejecting path 81 serving as a first conveyance path, and eject the sheet 5 in a face-down manner to the catch tray 8. A conveyance path, which conveys the sheet 5 between the lower guide member 73 and the upper guide member 74, is referred to as a conveyance path 70.

At an exit side of the conveyance path 70, there is provided a switching mechanism 60 for switching the sheet conveyance path between the reverse sheet ejecting path or the first sheet ejecting path 81 for ejecting the sheet 5 in a face-down manner to the catch tray 8, a second sheet ejecting path 82 for ejecting the sheet 5 to a later-described linear catch tray 181 and the duplex unit 10.

The duplex unit 10 integrally includes a vertical conveyance unit 101*a* and a horizontal conveyance unit 101*b*. The vertical conveyance unit 101*a* forms a vertical duplex conveyance path 90*c* which receives the sheet 5 being transferred from a side portion of the apparatus main body 1 and conveys the sheet 5 in a downward direction. The horizontal conveyance unit 101*b* forms a horizontal intake/conveyance path 90*a* which conveys the sheet 5 in a horizontal direction subsequently to the vertical duplex conveyance path 90*c*, and a switchback transportation path 90*b*.

The vertical duplex conveyance path 90*c* is provided with a pair of duplex entrance rollers 91 and a pair of conveyance rollers 92. The pair of duplex entrance rollers 91 conveys the sheet 5 in the downward direction. The pair of conveyance rollers 92 conveys the sheet 5 to the horizontal intake/conveyance path 90*a*. The horizontal intake/conveyance path 90*a* is provided with five pairs of duplex conveyance rollers 93. The switchback conveyance path 90*b* is provided with a pair of duplex exit rollers 94 and three pairs of duplex conveyance rollers 95. The pair of duplex exit rollers 94 is formed of reverse rollers which reverse the sheet 5 transferred from the horizontal intake/conveyance path 90*a* so as to re-feed the sheet 5.

Furthermore, a switching plate 96 is swingably provided so as to switch the conveyance path of the sheet 5 between the path from the horizontal intake/conveyance path 90*a* to the switchback conveyance path 90*b* and the path for re-feeding the sheet from the switchback conveyance path 90*b* to the pair of the conveyance rollers 48. The switching plate 96 is swingable at a position between a switchback position indicated in a solid line and a re-feeding position indicated in a dotted line in FIG. 1.

The sheet 5 fed from the duplex unit 10 is conveyed to the conveyance rollers 48 and then to the registration rollers 44.

As shown in FIG. 1 and FIG. 3, an open/close guide panel 110 is swingably provided facing a guide member 111 such that when the registration rollers 44 convey the sheet 5 fed from the sheet feed cassette 41 of the sheet feeding unit 4, the manual feed tray 46 and the duplex unit 10, some slack or a loop is formed in the sheet 5 between the conveyance roller 32 and the pressing rollers 36 of the subscanning conveyance unit 3, and between the registration rollers 44. Accordingly, backtension against the sheet 5 may be prevented. Furthermore, the open/close panel 110 is swingably moved by a not-shown open/close guide panel solenoid 113.

When the sheet 5 is transferred from the registration rollers 44 to the subscanning conveyance unit 3, the open/close guide panel 110 swings from the position shown in FIGS. 1 and 3 towards the guide member 111 so as to guide the sheet 5. At the time when the sheet 5 reaches the subscanning conveyance unit 3, the open/close guide panel 110 returns to the state shown in FIGS. 1 and 3 so that it becomes possible to form a loop.

Furthermore, in the image forming apparatus, in order to manually feed a single sheet, as shown in FIG. 1, a single-sheet manual feed tray 141 is provided at one side of the apparatus main body 1, and is openable and closable or may be pulled open relative to the apparatus main body 1. When a single sheet is fed, the single-sheet manual feed tray 141 is pulled open to the position shown by a dash-double dotted line. The sheet 5 manually fed from the single-sheet manual feed tray 141 is guided on the open/close guide panel 110 and may be linearly inserted between the conveyance roller 32 and the pressing roller 36A of the subscanning conveyance unit 3.

Furthermore, in order to linearly eject, in a face-up manner, the sheet 5 on which an image has been formed, the linear catch tray 181 is openably and closably provided at the other side of the apparatus main body 1. When the linear catch tray 181 is opened (pulled open), the second sheet ejecting path 82 for linearly ejecting the sheet 5 transported from the lower guide member 73 and the upper guide member 74 to the linear catch tray 181 is formed in the sheet ejecting unit 7.

Accordingly, when the sheet 5 having a relatively large thickness such as an OHP film which may be difficult to curvilinearly transfer is used, the sheet 5 may manually be fed from the single-sheet manual feed tray 141 and may linearly be conveyed to the linear catch tray 181. Needless to say, a normal sheet may also be fed from the single-sheet manual feed tray 141 and may linearly be ejected to the linear catch tray 181.

With reference to FIG. 4, a description will now be provided of positions of various sensors. In order to detect the sheet 5, a conveyance registration sensor 201 is provided on an upstream side of the registration rollers 44. Before the conveyance roller 32 and the pressing roller 36A, a print entry sensor 202 is disposed. On a downstream side of the pressing roller 36B or at an entrance to the image forming unit 2, an image registration sensor 203 for registering a start position of image writing is disposed. At an exit to the image forming unit 2 or before the conveyance roller 71*a*, a print exit sensor 204 is disposed. On an upstream side of the vertical conveyance roller 48, an electromagnetic clutch open sensor 205 is disposed. A sheet detection sensor 207 for detecting the sheet 5 placed on the single-sheet manual feed tray 141 is disposed.

Figure 6:
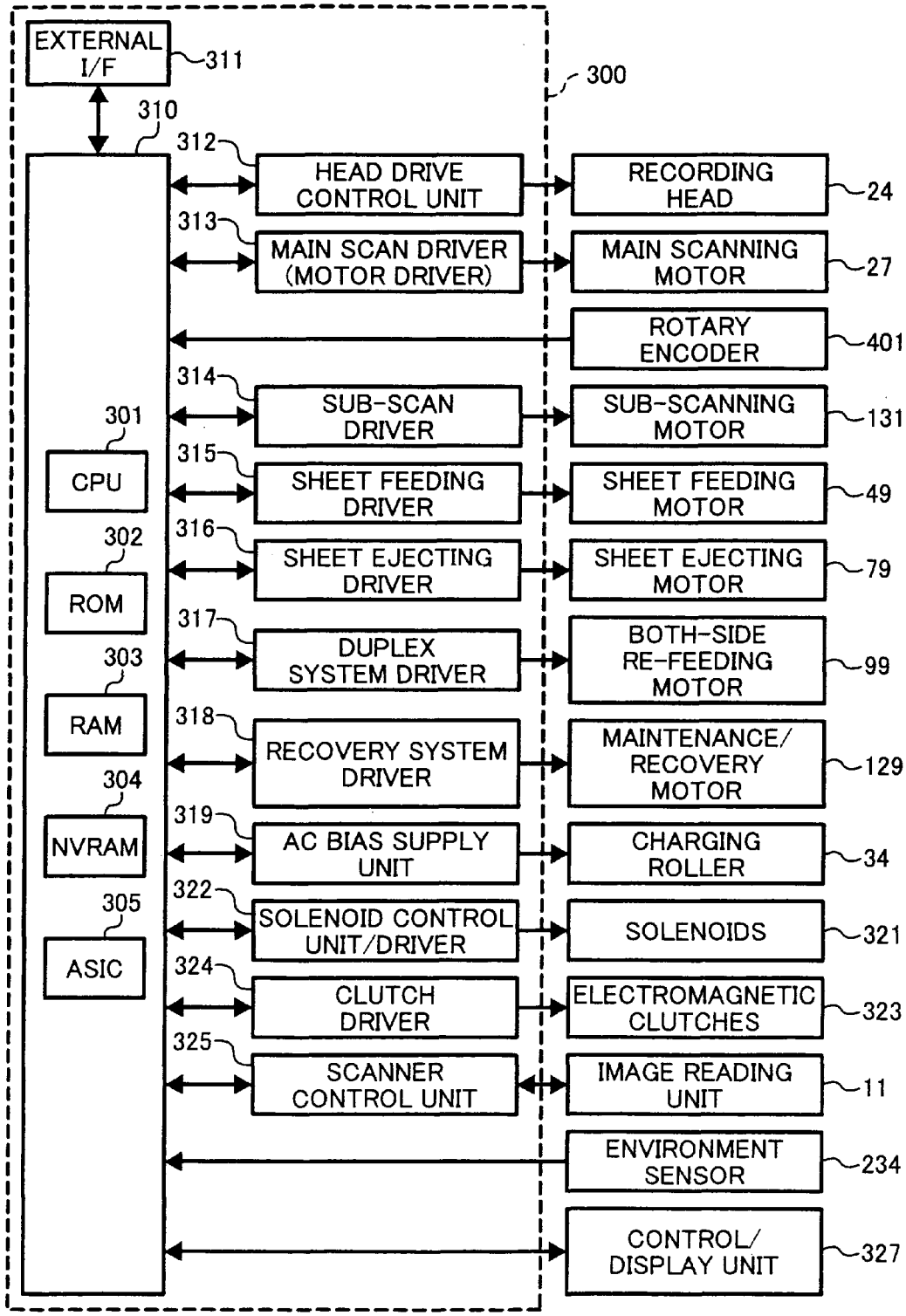
FIG. 6 is a block diagram illustrating a control unit.

With reference to a block diagram of FIG. 6, a description will be provided of a control unit of the image forming apparatus. A control unit 300 governs the control of an entire apparatus and is equipped with a main control unit 310. The main control unit 310 includes a CPU 301, a ROM 302, a RAM 303, a non-volatile memory (NVRAM) 304 and an ASIC 305. The ROM 302 stores programs carried out by the CPU 301 and other fixed data. The RAM 303 temporality stores data such as image data. The NVRAM 304 maintains data while the power of the apparatus is in an off-state. The ASIC 305 carries out various processing such as various signal processing relative to image data, image processing for sorting images and input/output signal processing for controlling the apparatus.

The control unit 300 includes an external interface (I/F) 311, a head drive control unit 312, a main scan driver or motor driver 313, a sub-scan driver 314, a sheet feeding driver 315, a sheet ejecting driver 316, a duplex system driver 317, a recovery system driver 318, an AC bias supply unit 319. The external I/F 311 mediates between the host side and the main control unit 310, and transmits and receives data and signals. The head drive control unit 312 includes a head driver for controlling driving of the recording heads 24. The main scan driver or the motor driver 313 drives the main scanning motor 27 which causes the carriage to move and scan. The sub-scan driver 314 drives the sub-scanning motor 131. The sheet feeding driver 315 drives the sheet feeding motor 49. The sheet ejecting driver 316 drives a sheet ejecting motor 79 which drives each roller of the sheet ejecting unit 7. The duplex system driver 317 drives a both-side re-feeding motor 99 which drives each roller of the duplex unit 10. The recovery system driver 318 drives a maintenance/recovery motor 129 which drives the maintenance/recovery device 121. The AC bias supply unit 319 supplies AC bias to the charging roller 34.

Furthermore, the control unit 300 is equipped with a solenoid driver 322, a clutch driver 324 and a scanner control unit 325. The solenoid control unit/driver 322 drives a various kinds of solenoids (SOL) 321 including the above-described open/close guide panel solenoid 113 and a shutter solenoid 150. The clutch driver 324 drives electromagnetic clutches 323 associated with sheet feeding. The scanner control unit 325 controls the image reading unit 11.

Detection signals of an environment sensor 234, which detect surrounding temperature and humidity or an environment condition of the conveyance belt 31, are input to the main control unit 310. Detection signals from other not-shown various sensors are also input to the main control unit 310. The main control unit 310 loads input keys necessary between various kinds of keys provided to the apparatus main body 1 such as numeric keys and a print start key, and a control/display unit 327 including various display devices. The main control unit 310 also outputs display information.

Furthermore, an output signal or a pulse from a rotary encoder 401 formed of the above-described codewheel 137 and the photo sensor or encoder sensor 138 is input to the main control unit 310. Based on the output signal, the main control unit 310 controls driving of the sub-scanning motor 131 through the sub-scan driver 314 causing the conveyance belt 31 to move through the conveyance roller 32.

Figure 7:
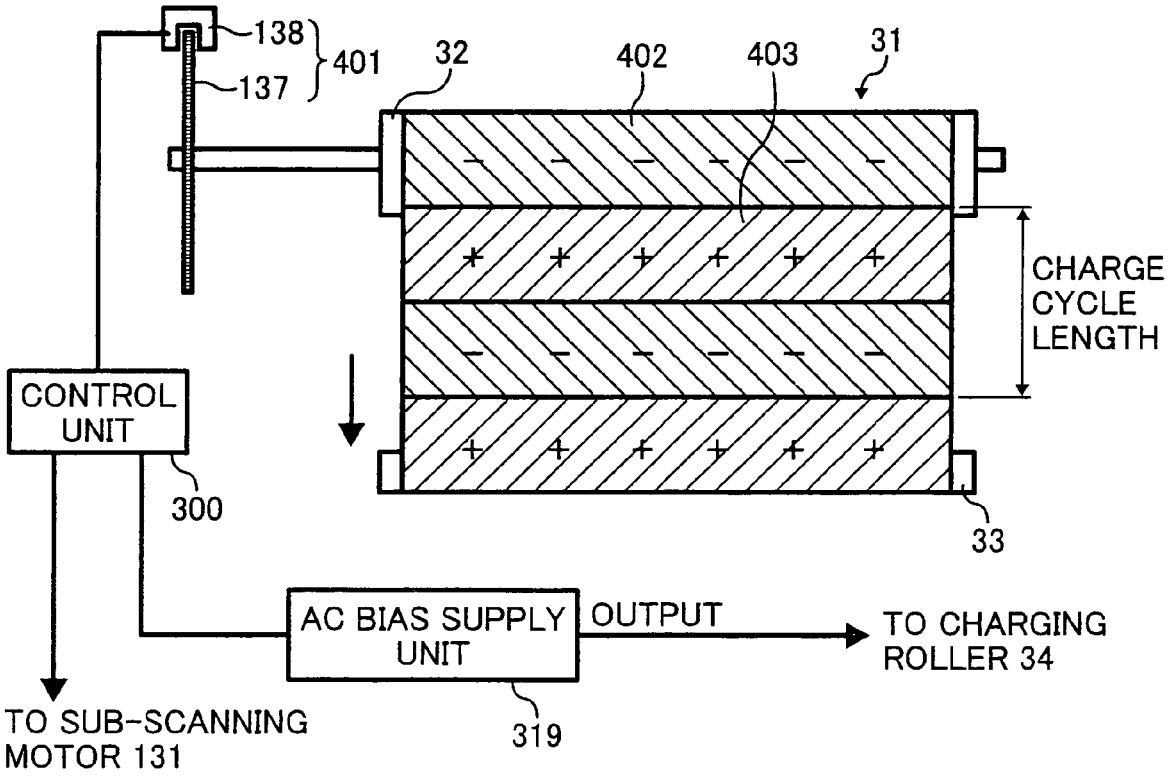
FIG. 7 is a schematic diagram for explaining a charging control of the conveyance belt.

With reference to FIG. 7, a description will be provided of an operation of sheet conveyance and image formation in the image forming apparatus having such a structure described above. As described above, the rotary encoder 401 provided at the end portion of the conveyance roller 32 which drives the conveyance belt 31 detects the amount of rotation. In accordance with the detected rotation amount, the sub-scan driver 314 of the control unit 300 controls driving of the subscanning motor 131. In the meantime, an output of the AC bias supply unit 319 which applies a high voltage or an AC bias to the charging roller 34 is controlled.

When the AC bias supply unit 319 controls a cycle or a duration of application voltage or charging bias of positive and negative electrodes to be applied to the charging roller 34, and in the meantime, the control unit 300 controls driving of the conveyance belt 31, the positive and negative electric charges may be applied on the conveyance belt 31 for a predetermined charge cycle length. The charge cycle length herein refers to, as shown in FIG. 7, a width or a distance of the positive and negative application voltage per one cycle in the conveyance direction shown by an arrow.

When printing is initiated, the sub-scanning motor 131 rotatively drives the conveyance roller 32 so that the conveyance belt 31 is rotated counter clock-wise in FIG. 1. In the meantime, the AC bias supply unit 319 applies a positive and negative square wave relative to the charging roller 34. Consequently, since the charging roller 34 is in contact with the front surface layer or insulating layer 31A of the conveyance belt 31, as shown in FIG. 7, a positive charge and negative charge are alternately applied to the front surface layer or the insulating layer 31A relative to the conveyance direction of the conveyance belt 31 shown by the arrow. In other words, a charging region 402 of a positive strip electrode and a charging region 403 of a negative strip electrode are alternately formed. Accordingly, a non-uniform electric field is formed on the conveyance belt 31.

The front surface layer or insulating layer 31A of the conveyance belt 31, on which the positive and negative charges are applied, is formed such that, for example, a volume resistance will be greater than or equal to 1E12 Ωcm, desirably 1E15 Ω cm. Therefore, the positive and negative charges charged on the front surface layer or insulating layer 31A are prevented from moving in the boundary. As a result, the positive and negative charges applied to the front surface layer or insulating layer 31A may be maintained.

When the sheet 5 is transferred onto the conveyance belt 31 on which the non-uniform electric field is generated, the sheet 5 is immediately polarized along a direction of the electric field. Because of the non-uniform electric field, electric charges on the surface of the sheet 5 which is the conveyance belt surface side attracting the conveyance belt 31 become dense, while electric charges on the opposite surface of the sheet 5, which serve as a repulsive force against the conveyance belt 31 become sparse. Due to the difference in the electric charges, the sheet 5 immediately sticks to the conveyance belt 31. In the meantime, since the sheet 5 has a finite resistance, true electric charges are induced on the surface of the sheet 5 absorbed to the conveyance belt 31 and the opposite surface.

The positive and negative true electric charges induced on the suction surface attract the electric charges applied on the conveyance belt surface 31. Consequently, a stable suction is attained. However, the positive and negative true electric charges induced on the opposite side are not stable. The true electric charges induced on the suction surface and on the opposite surface which is the front surface of the sheet 5 have a finite resistance value of the sheet 5 between 1E7Ω and 1E13Ω so that the electric charges may be able to move. Accordingly, the positive and negative electric charges next to each other are neutralized and reduced over time, as the positive and negative electric charges are attracted to each other and move. As a result, the electric charges on the conveyance belt 31 are balanced by the true electric charges induced on the suction surface of the sheet 5 so that the electric field is closed. The true electric charges induced on the suction surface of the sheet 5 and on the opposite surface are neutralized, and thus the electric field is closed. The electric charges applied on the surface of the conveyance belt 31 and the electric charges serving as the repulsive force against the electric charges of the conveyance belt 31 are decreased on the front surface of the sheet 5. Consequently, the suction of the sheet 5 to the conveyance belt 31 increases over time. The rotary movement of the conveyance belt 31 electrostatically absorbs and transports the sheet 5.

While the sheet 5 is intermittently transported by the conveyance belt 31, the recording heads 24 eject droplets of the recording liquid or ink droplets on the sheet 5 in accordance with print data so as to form or print an image. The tip of the sheet 5, on which the image is formed, is separated from the conveyance belt 31 by the separation claw 38, and is ejected to the catch tray 8 or the linear catch tray 181 by the paper ejecting unit 7 as necessary. The sheet 5 may also be transferred to the duplex unit 10 so that an image is formed on the other surface, and then may be ejected.

Figure 8:
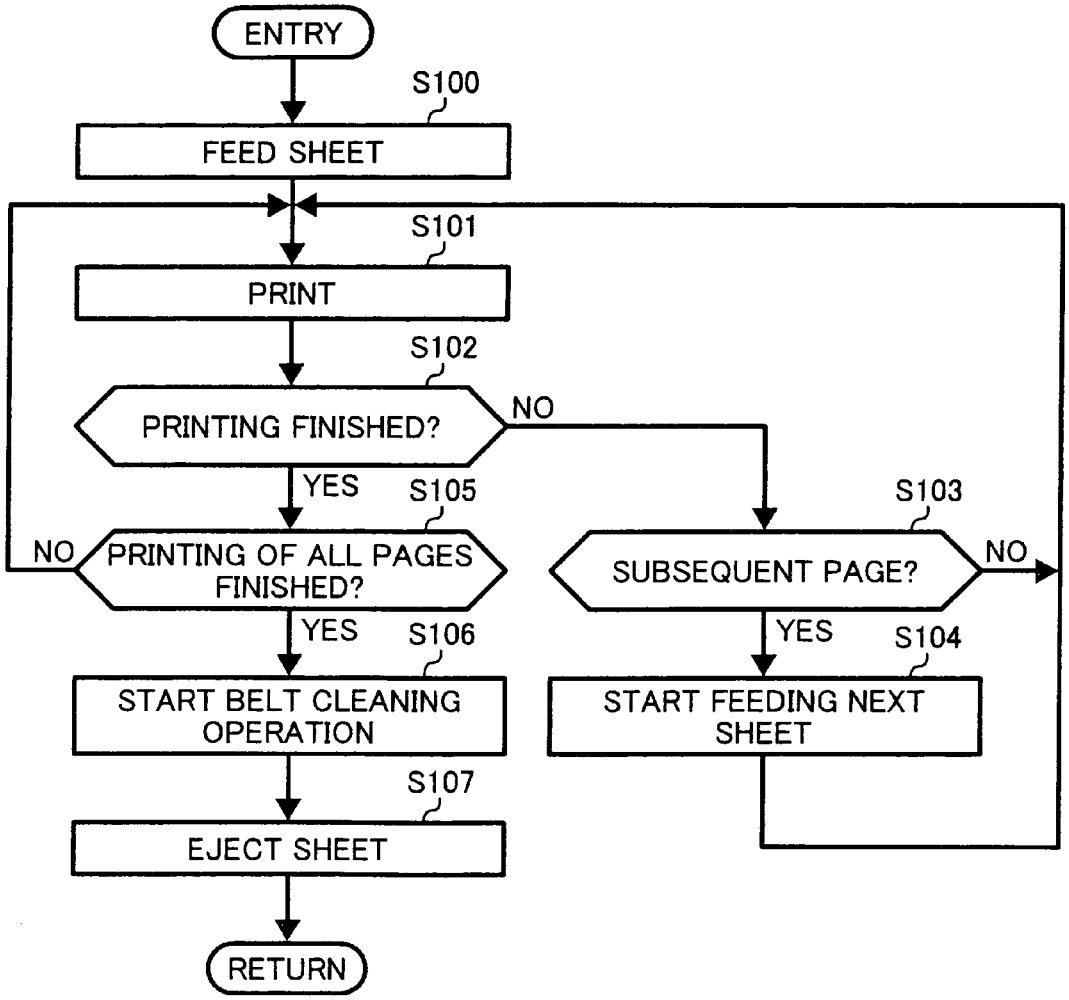
FIG. 8 is a flowchart showing a first exemplary procedure of the present disclosure.
Figure 9:
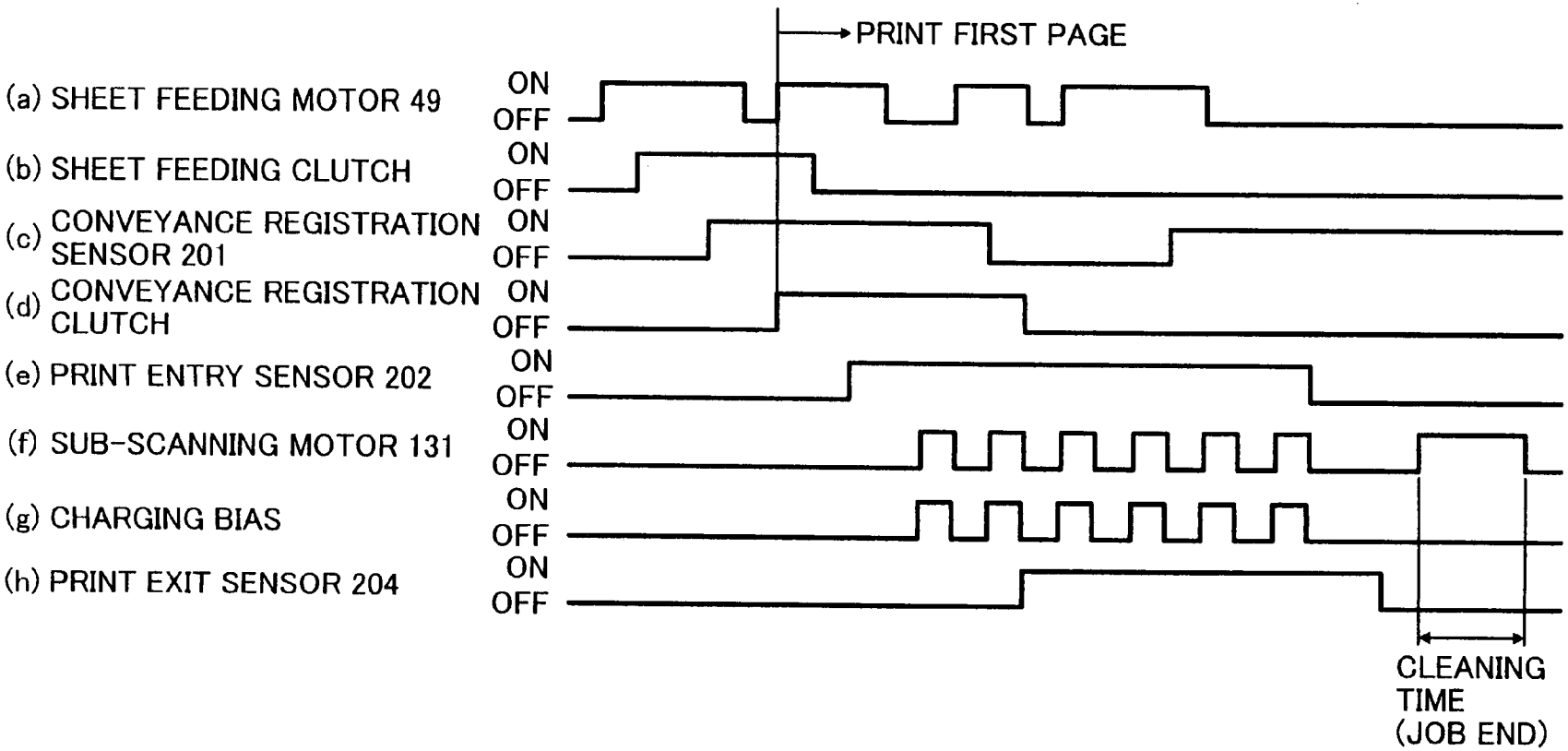
FIG. 9 is a timing chart for explaining the first exemplary procedure of the present disclosure.

Next, a description will be provided of an exemplary procedure of the present disclosure with reference to FIG. 8 and FIG. 9. FIG. 8 is a flowchart, and FIG. 9 is a timing chart illustrating the exemplary procedure.

The first exemplary embodiment is an example of a belt cleaning operation to be performed for each job. First, with reference to FIG. 8, when printing is carried out, the sheet 5 is fed to perform predetermined printing (Step S100 and S101). Subsequently, whether or not printing is finished is determined (Step S102). If printing is not finished (NO in Step S102), whether or not there is a subsequent page is determined (Step S103). If there is a subsequent page (YES in Step S103), the subsequent sheet feeding is initiated (Step S104). When printing of the page is finished, printing operation is repeated until printing of all the pages is finished.

Subsequently, when printing of all the pages is finished (YES in Step S105), a belt cleaning operation, in which the conveyance belt 31 is rotatively moved or driven, is performed in a state where the charging bias to be applied to the charging roller 34 is decreased (Step S106). When ejection of all the pages is completed (Step S107), this processing is terminated.

With reference to FIG. 9, a description will be provided of the above-described operation in a case where printing of a single sheet is performed, for example.

As shown in FIG. 9 (*a*), if the sheet feeding motor 49 is in an ON state, and the sheet feeding clutch of the apparatus main body is also in an ON state as shown in FIG. 9 (*b*), the sheet 5, which is a single sheet, is separated from the sheet feed cassette 41 and is fed. Subsequently, as shown in FIG. 9 (*c*), the sheet feeding motor 49 is turned off after a required time elapses from when the conveyance registration sensor 201 detects the sheet 5. Then, when the predetermined time elapses, a conveyance registration clutch is turned ON as shown in FIG. 9 (*d*). In the meantime, the sheet feed motor 49 is turned ON. Accordingly, transportation of the sheet 5 to the conveyance belt 31 is initiated.

Subsequently, as shown in FIG. 9 (*e*), after the print entry sensor 202 detects the sheet 5, the sheet supply motor 49 is turned off. Accordingly, transportation of the sheet 5 is stopped and is in a standby state. After a predetermined standby time elapses, the sheet motor 49 is turned on to initiate transportation of the sheet 5. In the meantime, when the sub-scanning motor 131 is driven or turned on as shown in FIG. 9 (*f*), and the charging bias is applied relative to the charging roller 34 as shown in FIG. 9 (*g*) so as to apply electric charges to the conveyance belt 31 as described above, the electrostatic suction is generated. Accordingly, the conveyance belt 31 electrostatically absorbs the sheet 5 and starts transferring the sheet 5.

When the print entry sensor 202 detects a rear end of the sheet 5 and is turned off, the sub scanning motor 131 is turned off. In the meantime, application of the charging bias relative to the charging roller 34 is stopped.

In such a manner, printing on the single sheet 5 is performed. When the print exit sensor 204 detects the rear end of the sheet 5 passing as shown in FIG. 9 (*h*), and one job is finished, the belt cleaning operation is performed. The belt cleaning operation is carried out such that the conveyance belt 31 is driven or rotatively moved by driving the sub-scanning motor 131 while application of the charging bias relative to the charging roller 34 is stopped.

In the belt cleaning operation, the conveyance belt 31 moves in a state where the Mylar 231 and the cleaning brush 232 are in contact with the conveyance belt 31, and no electric charge is applied to the conveyance belt 31. Accordingly, charged products and/or paper powder on the surface of the conveyance belt 31 may be swept by the Mylar 231 and the cleaning brush 232 in a state where the charged products are not generated on the conveyance belt 31. As a result, the deterioration of the suction of the conveyance belt 31 over time may be suppressed, thereby allowing stable transportation of the sheet for an extended period of time.

In such a manner, when a conveyance belt is driven in a state where a contact member is provided contacting the surface of the conveyance belt, and a charging bias voltage relative to a charging mechanism is reduced, charged products adhered to the belt surface may be removed, thereby preventing the deterioration of the suction of the conveyance belt over time.

In this case, the PET film or the Mylar 231 may be used as the contact member so that the charged products on the belt surface may be removed with an economical structure. When the contact member such as the PET film or the Mylar 231 comes into contact with the contact belt in a direction counter to that of the conveyance belt, removal of the charged products may be enhanced. Further, the charged products on the belt surface may be removed more effectively if the cleaning brush 232 having a brush-like shape is used as a contact member. In addition, when the contact member is disposed at a position further upstream side in the conveyance belt moving direction than the discharging brush 233 which discharges the conveyance belt surface, the paper powder may simultaneously be removed together with the charged products, thereby reducing an effect of the paper powder relative to the discharging mechanism at the downstream side.

If the charging bias voltage is in an off-state or the charging bias is not applied such as the state in which the charging bias voltage relative to the charging mechanism is reduced, the charged products on the conveyance belt surface may be removed by the contact member while more assuredly suppressing generation of the charged products.

In this case, in a state where the charging bias voltage relative to the charging mechanism is reduced, the voltage of the conveyance belt may be in the voltage region in which the conveyance belt does not generate suction or may be less than the bias at the beginning of the charging, while the charging bias voltage is applied. Therefore, the amount of the removed charged products by the contact member is greater than the amount of generation of the charged products. Accordingly, the deterioration of suction of the belt over time may be suppressed.

A structure, that allows a reduction of the charging bias to the region in which the conveyance belt does not generate suction while the charging bias voltage is applied, may adopt the structure which changes the charge cycle length described in FIG. 7, when the AC bias is applied as described above. In other words, if the charge cycle length is short, the suction is reduced. Consequently, the output of the AC bias supply unit 319 is controlled such that the charge cycle length becomes short relative to the charge cycle length at the time of normal image formation, when the belt cleaning operation is performed.

Furthermore, as described above, a reduction of the printing speed during continuous printing may be prevented, if the belt cleaning operation is performed each time a series of printing or image forming operations for the sheet are finished, that is, each time one job is finished. Thereby, the printing speed of continuous printing may be enhanced while the deterioration of the belt suction is suppressed.

Figure 10:
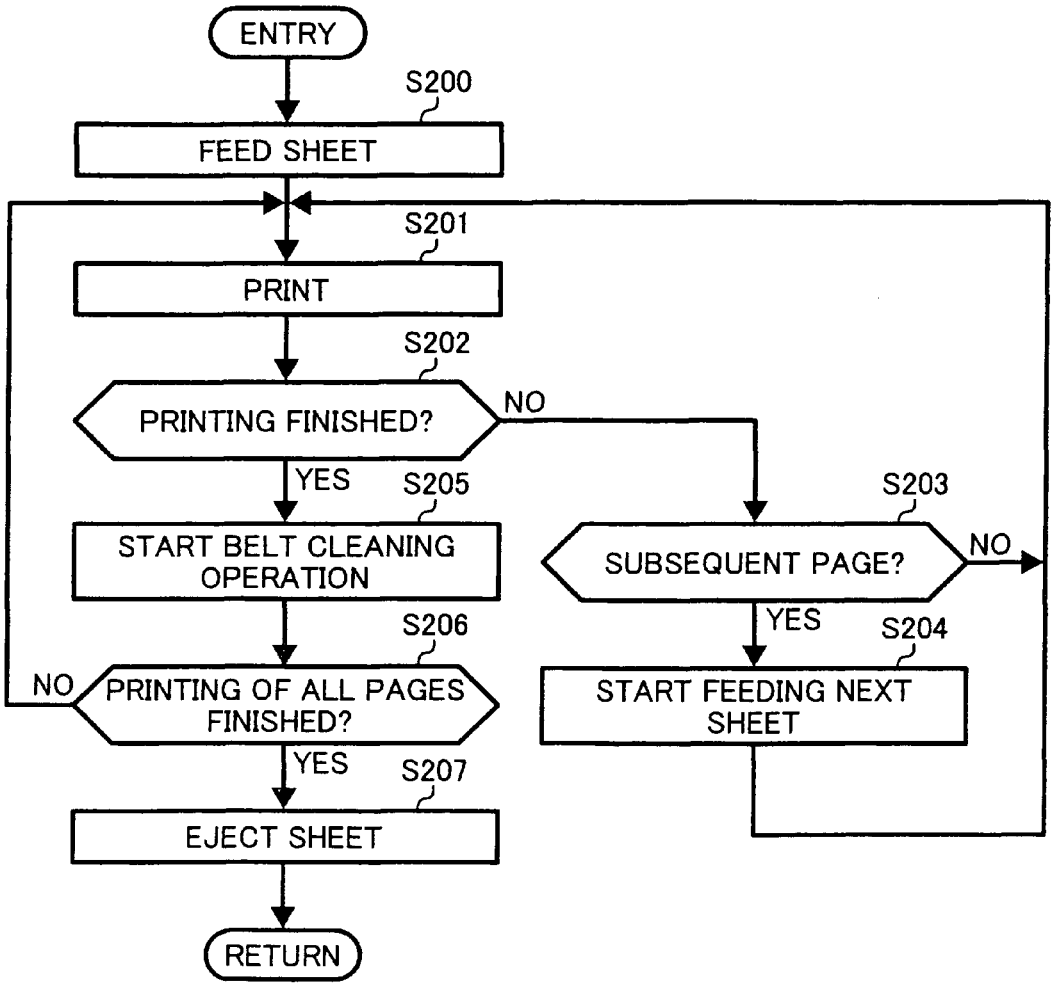
FIG. 10 is a flowchart showing a second exemplary procedure of the present disclosure.
Figure 11:
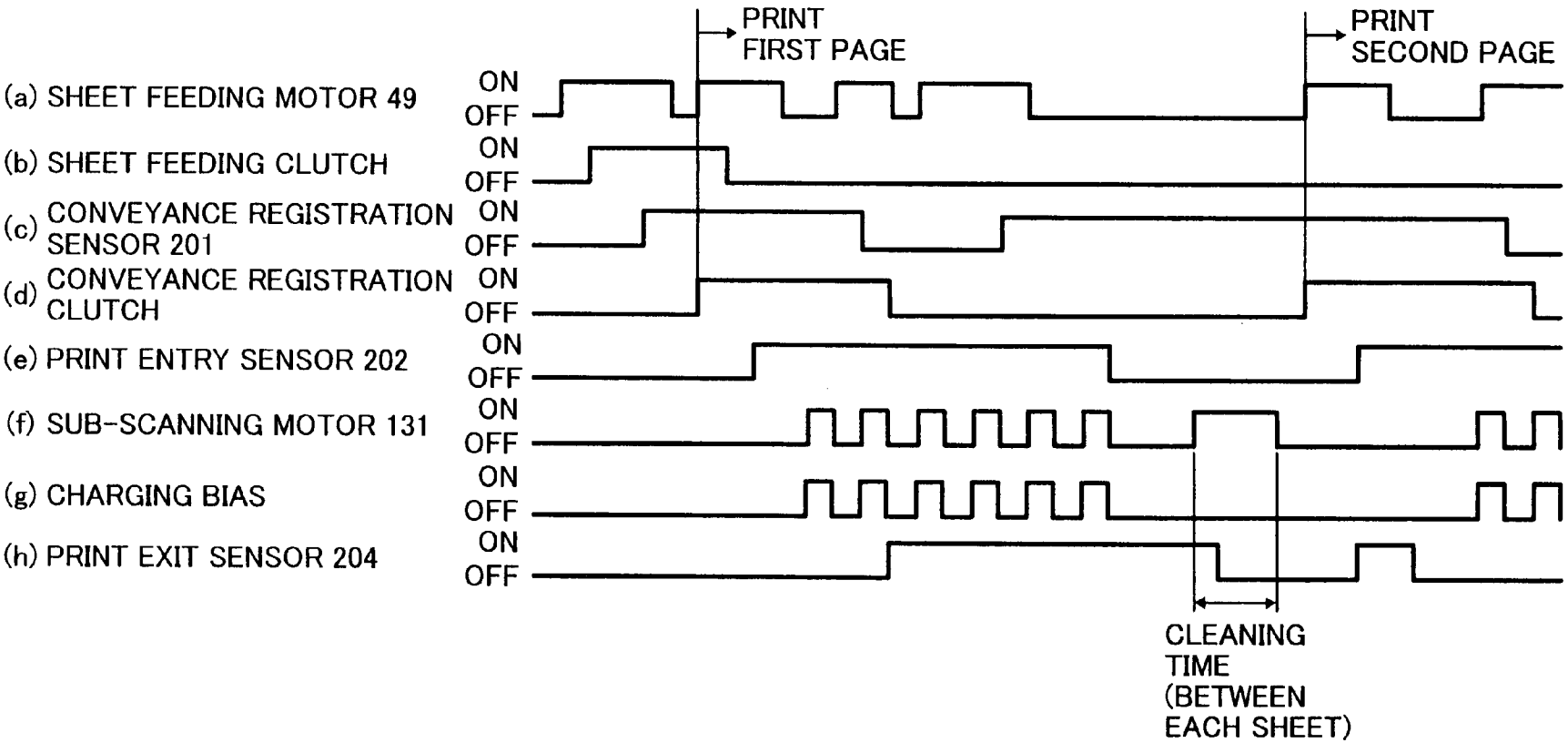
FIG. 11 is a timing chart for explaining the second exemplary procedure of the present disclosure.

Next, with reference to FIGS. 10 and 11, a description will be provided of another exemplary procedure of the image forming apparatus of the present disclosure. FIG. 10 is a flowchart, and FIG. 11 is a timing chart for explaining the exemplary embodiment. This exemplary embodiment is an example in which the belt cleaning operation is carried out between printing of each sheet. With reference to FIG. 10, when the printing is carried out, the sheet 5 is fed for printing (S200 and S201). If the printing is not finished (NO in Step S202), whether or not there is a subsequent page is determined (S203). If there is a subsequent page (YES in Step S203), the subsequent sheet feeding is initiated at a predetermined timing (S204). When the respective printing of the page is finished, the belt cleaning operation, in which the conveyance belt 31 is rotatively moved or driven, is performed in a state where the charging bias applied to the charging roller 34 is reduced (S205).

The printing operation is repeated until printing of all the pages is finished (S206). When ejection of all the pages is completed (S207), the printing operation is finished.

In other words, as shown in FIG. 11, the belt cleaning operation is performed such that the subscanning motor 131 is driven so as to rotatively drive the conveyance belt 31 while the application of the charging bias to the charging roller 34 is stopped between each printing of the first page and the second page.

In such a manner, when the belt cleaning operation is performed between printing of each sheet, the sheet may be transported while the suction of the conveyance belt 31 is recovered.

Figure 12:
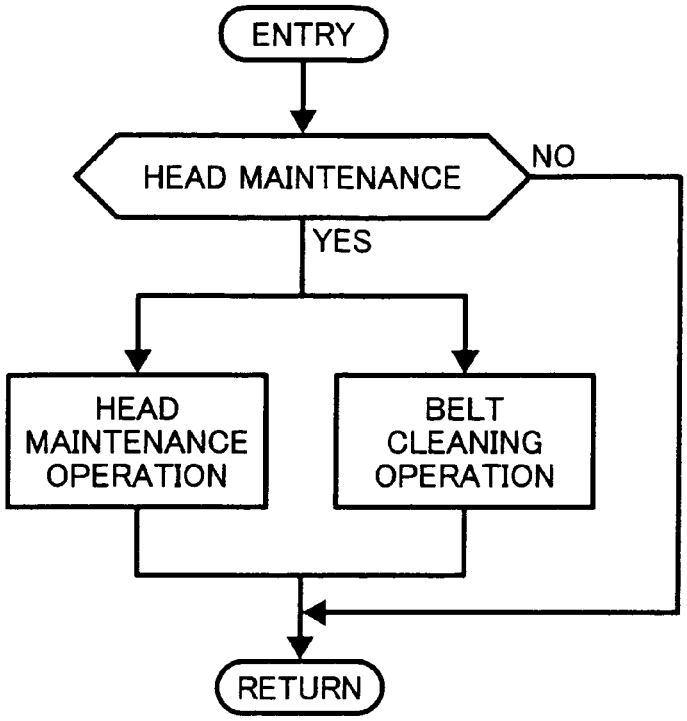
FIG. 12 is a flowchart showing a third exemplary procedure of the present disclosure.

Next, a description will be provided of another exemplary procedure of the present disclosure with reference to FIG. 12. FIG. 12 is a flowchart for explaining the third exemplary embodiment. In the third exemplary embodiment, when the nozzle condition maintenance/recovery device 121 performs a maintenance operation which includes the maintenance and the recovery of the condition of nozzles of the recording heads 24, the maintenance operation is performed in parallel with the belt cleaning operation. In the maintenance operation, a series of operations are performed. For example, the nozzle surfaces of the recording heads 24 are capped with the respective moisturizing caps 122 so as to perform the nozzle suction. The nozzle surfaces are then wiped to be cleaned.

In such a manner, the deterioration of the printing speed may be prevented during the continuous printing. Further, the deterioration of the belt suction may also be suppressed, while the printing speed during the continuous printing is enhanced.

Figure 13:
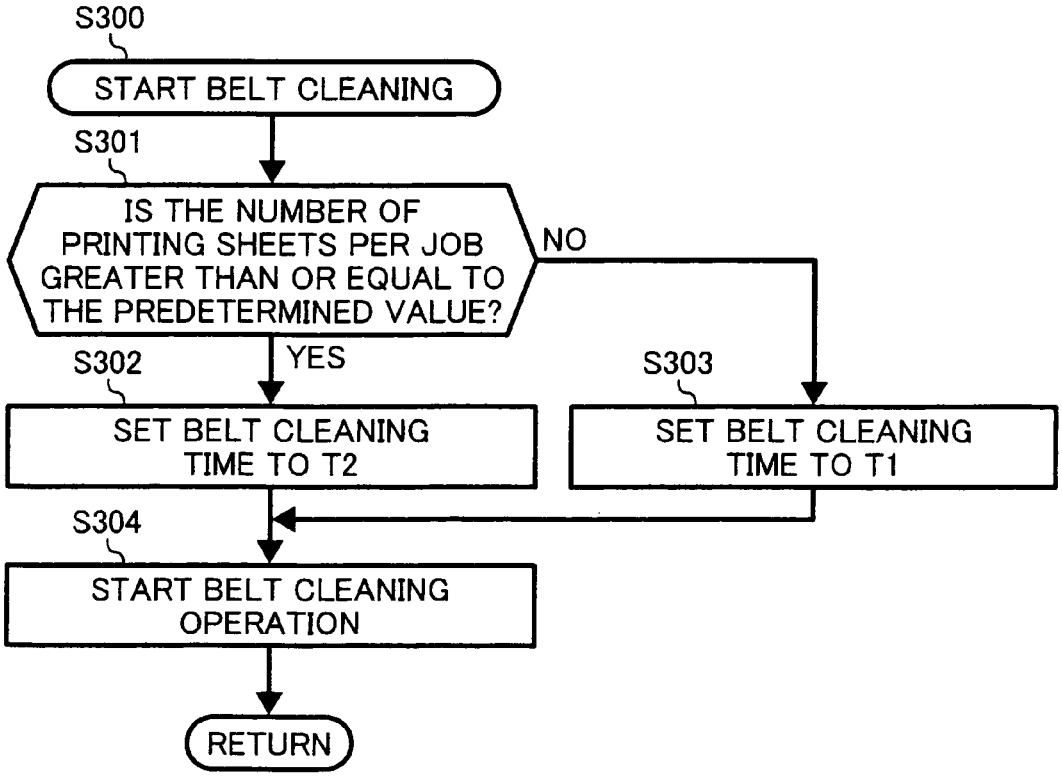
FIG. 13 is a flowchart showing a first exemplary procedure of a belt cleaning operation.

Next, one example of the belt cleaning operation is explained with reference to a flowchart of FIG. 13. When the belt cleaning processing is initiated (S300), whether or not the number of printing sheets per job does not exceed a predetermined value (sheets) is determined (S301). If the number of printing sheets per job does not exceed the predetermined value (sheets), a belt cleaning time T1 is set (S303). If the number of printing sheets per job is greater than or equal to the predetermined value (sheets), a belt cleaning time T2 (T2>T1) is set (S302). Subsequently, the belt cleaning operation is performed (S304) such that the conveyance belt 31 is driven in a state where the charging bias is not applied or the charging bias is reduced for the period of the belt cleaning time having been set.

In such a manner, if the belt cleaning time is changeable, the cleaning operation may be performed according to a situation where the charged compound is generated on the conveyance belt 31. Thereby, the charged compound may assuredly be eliminated. In such a case, if the belt cleaning operation time is changed based on the number of printing sheets which is the number of sheets being conveyed in a single operation, the charged compound may be eliminated more assuredly, and thus the deterioration of the suction of the conveyance belt may be prevented.

Figure 14:
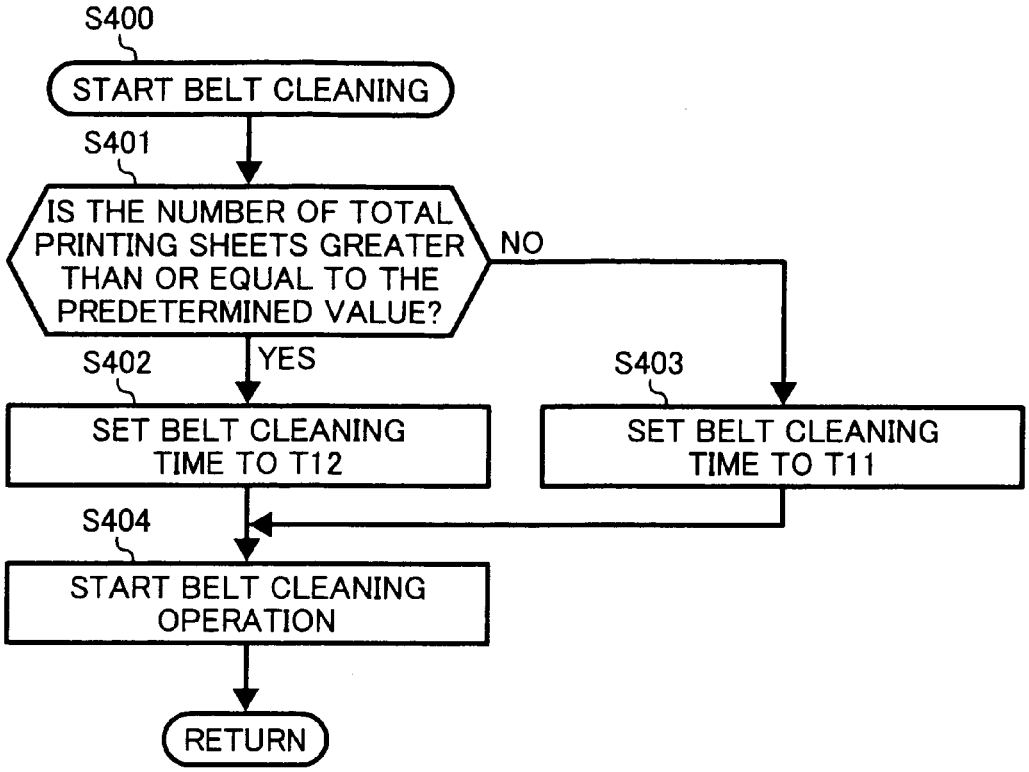
FIG. 14 is a flowchart showing a second exemplary procedure of a belt cleaning operation.

Next, a second example of the belt cleaning operation is explained with reference to a flowchart of FIG. 14. When the belt cleaning processing is initiated (S400), whether or not the total number of printing sheets exceed a predetermined value (sheets) is determined (S401). If the total number of printing sheets does not exceed the predetermined value (sheets), a belt cleaning time T11 is set (S403). If the total number of printing sheets is greater than or equal to the predetermined value (sheets), a belt cleaning time T12 (T12>T11) is set (S402). Subsequently, the belt cleaning operation is performed (S404) such that the conveyance belt 31 is driven in a state where the charging bias is not applied or the charging bias is reduced for the period of the belt cleaning time having been set.

In such a manner, if the belt cleaning operation time is changeable, the charged compound may be eliminated more assuredly by changing the belt cleaning operation time based on the total number of printing sheets or the accumulated number of the sheet member being conveyed, and thus the deterioration of the suction of the conveyance belt may be prevented.

Figure 15:
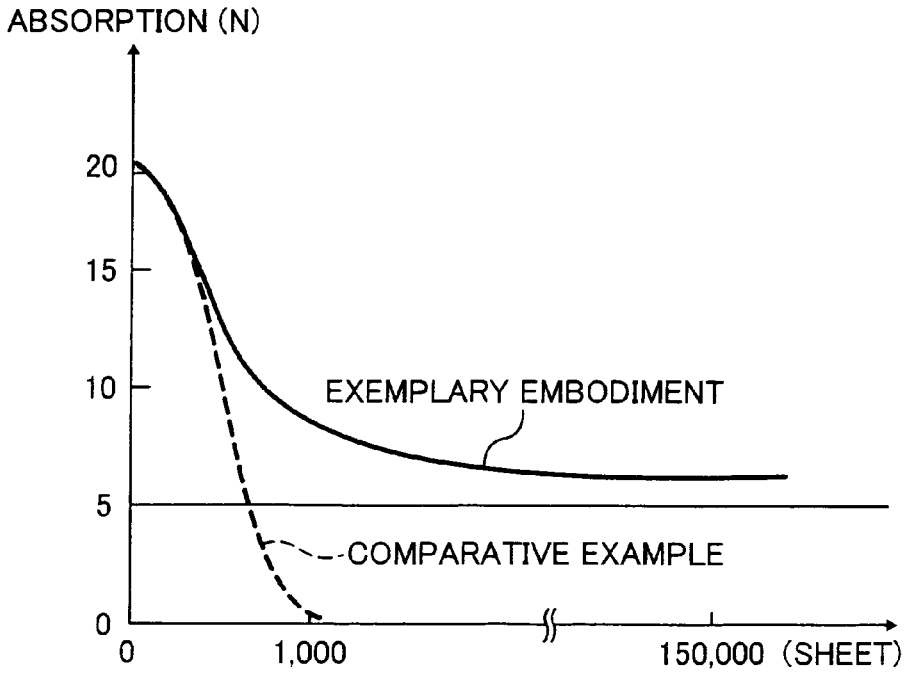
FIG. 15 is a chart showing absorption of the conveyance belt according to the exemplary embodiment and a comparative example.

Next, with reference to FIG. 15, a description will be provided of an effect of the exemplary embodiments of the present disclosure on the absorption of the conveyance belt. FIG. 15 shows changes in the absorption of the conveyance belt 31 when the sheet 5 is continuously fed in the exemplary embodiment and a comparative example. In the exemplary embodiment, the changes in the absorption of the conveyance belt 31 are measured when the belt cleaning operation is performed according to the exemplary embodiment. The cleaning operation is performed such that the conveyance belt is driven while the contact member is positioned in a manner contacting the conveyance belt 31, and the charging bias relative to the conveyance belt is reduced. In the comparative example, the changes in the absorption of the conveyance belt 31 are measured when the contact member is positioned in a manner contacting the conveyance belt, and the conveyance belt is driven in a state where the charging bias relative to the conveyance belt remains normal, that is, the charging bias is not reduced.

As may be seen from the result, in a case where the belt cleaning operation according to the exemplary embodiments of the present disclosure is not performed, the charged compound is eliminated by the contact member. However, the charged compounds are generated in the mean time. Thus, the absorption of the conveyance belt is significantly reduced, when 1,000 sheets are continuously conveyed. On the other hand, in a case where the belt cleaning operation according to the exemplary embodiments of the present disclosure is performed, the charged compound is eliminated by the contact member. In the meantime, even if the charged compound is generated, the amount of the generation of the charged compound is less than the elimination amount. Thus, the absorption of the conveyance belt may be maintained even after 150,000 sheets are continuously conveyed.

Figure 16:
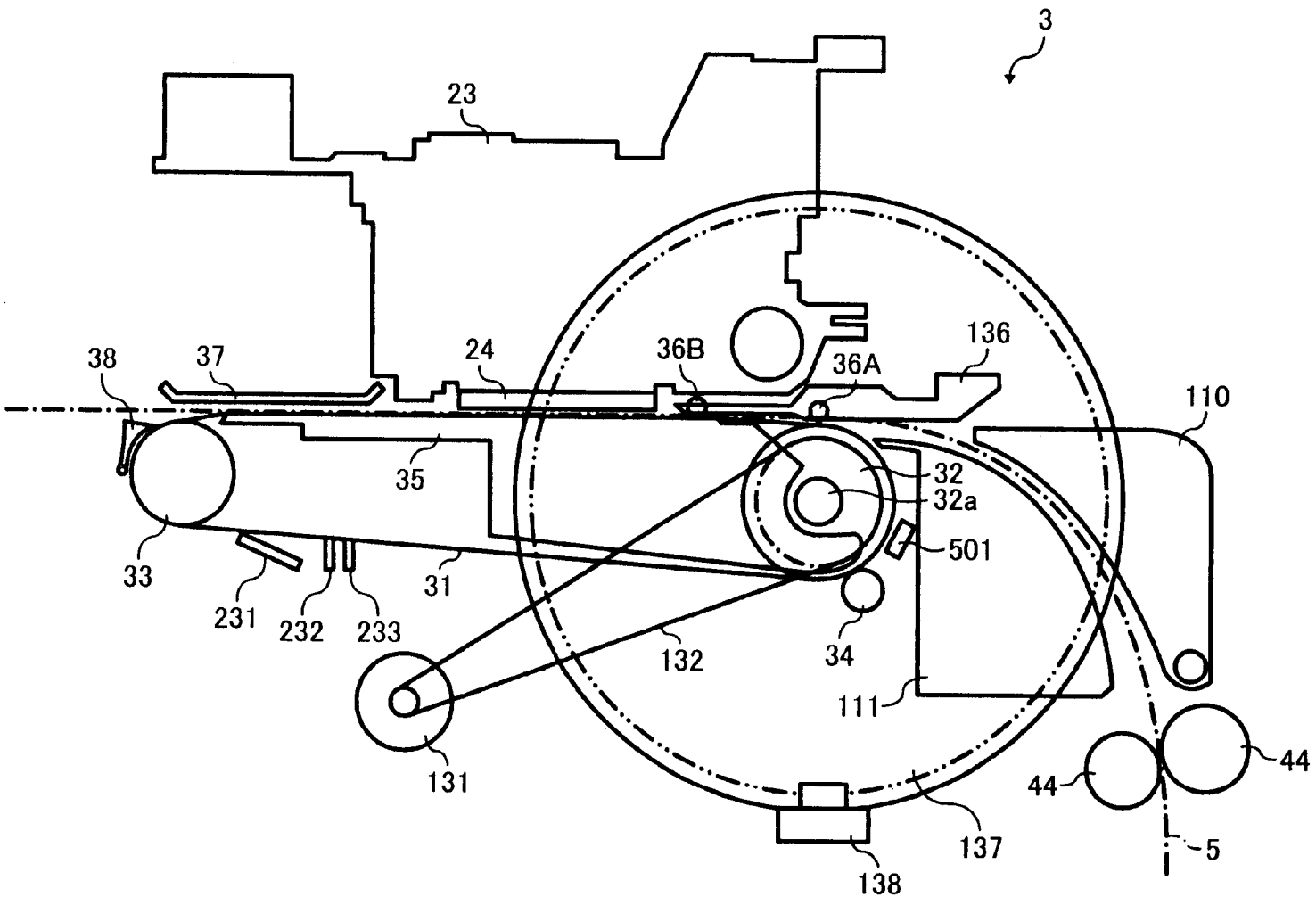
FIG. 16 is a cross-sectional view of a subscanning conveyance unit in another exemplary embodiment of the present disclosure.

Next, with reference to FIG. 16, a description will be provided of another exemplary embodiment of the present disclosure. Similar to FIG. 3, FIG. 16 is an enlarged side view. In the fourth exemplary embodiment, a surface electrometer 501 to measure the surface potential of the conveyance belt 31 is provided so that the resistance value of the conveyance belt 31 may be detected from the result of the measurement by the surface electrometer 501.

Figure 17:
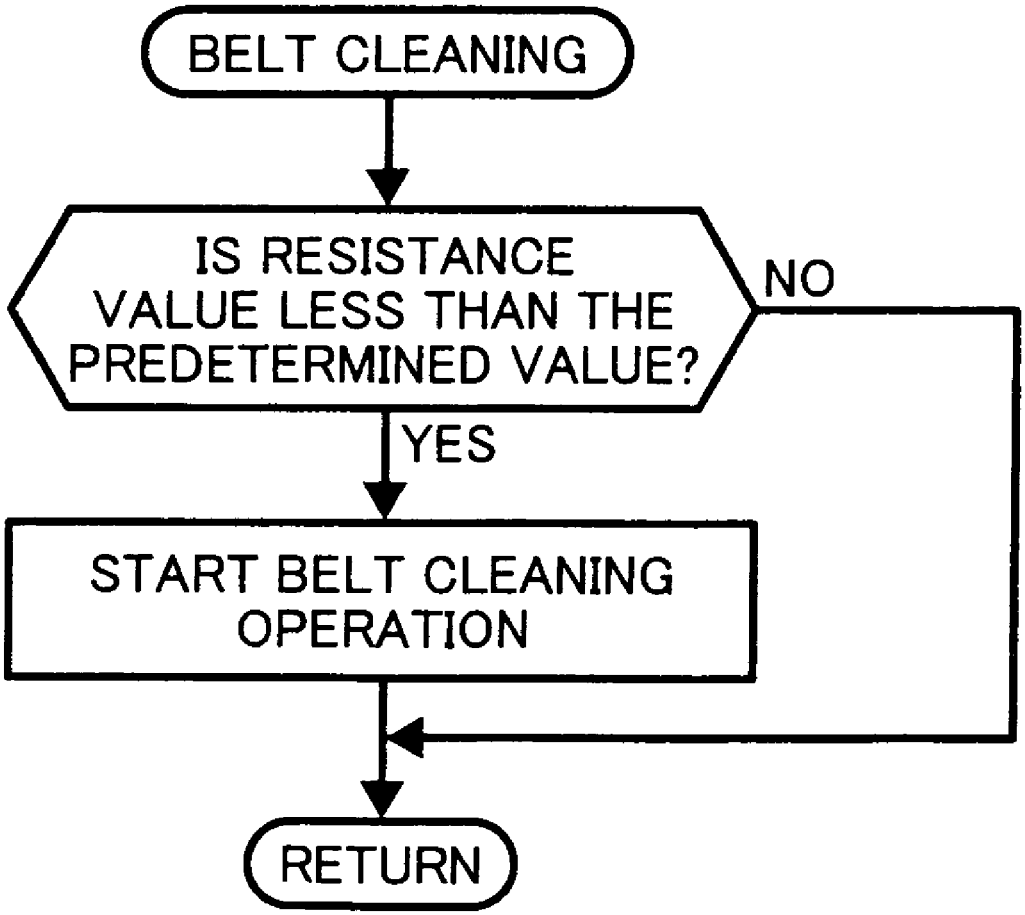
FIG. 17 is a flowchart showing a fourth exemplary procedure of the present disclosure.

As shown in FIG. 17, if the resistance value of the conveyance belt 31 is less than or equal to a predetermined value, similarly to the above-described exemplary embodiments, the belt cleaning operation according to the exemplary embodiments of the present disclosure is performed such that the contact member is positioned in a manner contacting the conveyance belt, and the charging bias relative to the conveyance belt is reduced.

In such a manner, the adherence state of the charged compound relative to the conveyance belt 31 is detected based on the resistance value of the conveyance belt 31, and the belt cleaning operation according to the exemplary embodiments of the present disclosure is performed when the amount of the charged compound relative to the conveyance belt 31 is increased. Accordingly, the charged compound may effectively be eliminated.

Furthermore, in the above-described exemplary embodiments, descriptions are provided using examples in which the subject matter of the present disclosure is applied to the multi-functional image forming apparatus. However, the subject matter of the present disclosure may be applied to other image forming apparatuses such as a printer, facsimile and so forth, and also to an image forming apparatus using a recording liquid other than ink. Furthermore, the subject matter of the present disclosure may be applied to an electrostatic conveyance apparatus as a sheet conveyance apparatus in the image forming apparatus, and to an electrostatic conveyance apparatus including other sheet conveyance apparatuses.

Embodiments of this disclosure may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. Embodiments of the present disclosure may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Further, any of the aforementioned methods may be embodied in the form of a program. The program may be stored on a computer readable media and is adapted to perform any one of the aforementioned methods, when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Exemplary embodiments being thus described, it should be apparent after reading this patent specification that the same may be varied in many ways. Such variations are not to be regarded as a departure from the spirit and scope of the present disclosure, and all such modifications as would be apparent to one skilled in the art are intended to be included within the scope of the following claims.

This patent specification is based on and claims priority under 35 U.S.C. §119 of Japanese patent application No. JP2005-343112 filed on Nov. 29, 2005 in the Japanese Patent Office, the entire contents of which are incorporated herein by reference.

What is claimed is:

1. An image forming apparatus which uses an electrostatic force to flatly hold a recording medium during conveyance, comprising:

a rotary belt for carrying a recording medium;

an image forming mechanism configured to perform an image forming operation to form an image on the recording medium carried by the rotary belt;

a driving mechanism configured to drive the rotary belt;

a contact member movably held near the rotary belt;

a charging mechanism configured to apply a charging voltage superimposed on a bias voltage to the rotary belt, to cause a suction force from the rotary belt to the recording medium; and a controller configured to cause a cleaning operation to be performed to the rotary belt only after a print job that includes one page or multiple pages has been completed, the cleaning operation including causing the contact member to be held in contact with the rotary belt, causing the driving mechanism to drive the rotary belt when the contact member is held in contact with the rotary belt, and reducing the bias voltage applied to the rotary belt by the charging mechanism from the charging voltage that causes the suction force from the rotary belt to the recording medium, to a reduced voltage that does not cause the suction force from the rotary belt to the recording medium, before performing the cleaning operation.

2. The image forming apparatus of claim 1, wherein the controller reduces the bias voltage of the charging mechanism to a reduced voltage which causes a corresponding reduced electrostatic force to suction the recording medium onto the rotary belt.

3. The image forming apparatus of claim 1, wherein the bias voltage is of an alternating voltage, and the controller shortens a charge cycle length to generate a reduced electrostatic force to suction the recording medium onto the rotary belt.

4. The image forming apparatus of claim 1, wherein the controller turns off the bias voltage of the charging mechanism.

5. The image forming apparatus of claim 1, wherein the contact member includes a PET film.

6. The image forming apparatus of claim 1, wherein the contact member is held in contact with the rotary belt in a direction counter to a moving direction of the rotary belt.

7. The image forming apparatus of claim 1, wherein the contact member has a brush-like form.

8. The image forming apparatus of claim 1, further comprising:

a discharging brush configured to discharge the rotary belt, wherein the contact member is positioned further upstream relative to the discharging brush in a moving direction of the rotary belt.

9. The image forming apparatus of claim 1, wherein the controller is further configured to vary a time period during which the rotary belt is driven by the driving mechanism, when the contact member is held in contact with the rotary belt and the bias voltage is varied so as to reduce the electrostatic force during the time other than the image forming operation by the image forming mechanism.

10. The image forming apparatus of claim 9, wherein the controller varies the time period during which the rotary belt is driven by the driving mechanism, based on a number of the recording medium carried by the rotary belt.

11. The image forming apparatus of claim 9, wherein the controller varies the time period during which the rotary belt is driven by the driving mechanism, based on a number of the recording medium carried by the rotary belt during one job of the image forming operation.

12. The image forming apparatus of claim 9, wherein the controller varies the time period during which the rotary belt is driven by the driving mechanism, based on an accumulated number of the recording medium carried by the rotary belt.

13. The image forming apparatus of claim 1, further comprising:

a measuring mechanism configured to measure a resistance of a surface of the rotary belt, wherein the controller causes the contact member to be held in contact with the rotary belt, causes the bias voltage to vary so as to reduce the electrostatic force during a time other than the image forming operation by the image forming mechanism, and causes the driving mechanism to drive the rotary belt when the contact member is held in contact with the rotary belt, and the bias voltage is varied so as to reduce the electrostatic force during the time other than the image forming operation by the image forming mechanism based on the resistance of the surface of the rotary belt measured by the measuring mechanism.

14. The image forming apparatus of claim 1, wherein the controller causes the contact member to be held in contact with the rotary belt, causes the bias voltage to vary so as to reduce the electrostatic force during a time other than the image forming operation by the image forming mechanism, and causes the driving mechanism to drive the rotary belt when the contact member is held in contact with the rotary belt, and the bias voltage is varied so as to reduce the electrostatic force during the time other than the image forming operation by the image forming mechanism, after the image forming mechanism completes a job of the image forming operation.

15. The image forming apparatus of claim 1, wherein the controller causes the contact member to be held in contact with the rotary belt, causes the bias voltage to vary so as to reduce the electrostatic force during a time other than the image forming operation by the image forming mechanism, and causes the driving mechanism to drive the rotary belt when the contact member is held in contact with the rotary belt, and the bias voltage is varied so as to reduce the electrostatic force during the time other than the image forming operation by the image forming mechanism, during a time period between two adjacent cycles of the image forming operations.

16. The image forming apparatus of claim 1, wherein the controller causes the contact member to be held in contact with the rotary belt, causes the bias voltage to vary so as to reduce the electrostatic force during the time other than the image forming operation by the image forming mechanism, and causes the driving mechanism to drive the rotary belt when the contact member is held in contact with the rotary belt, and the bias voltage is varied so as to reduce the electrostatic force during a time other than the image forming operation by the image forming mechanism, in a case where the controller performs a recovering operation relative to a defective condition of the image forming mechanism.

17. The image forming apparatus of claim 1, wherein the controller controls cleaning operations such that the cleaning operation is not performed during the image forming operation.

18. A sheet conveying apparatus which uses an electrostatic force to flatly hold a recording medium during conveyance and is employed in an image forming apparatus, comprising:

a rotary belt for carrying a recording medium;

a driving mechanism configured to drive the rotary belt;

a contact member movably held near the rotary belt;

a charging mechanism configured to apply a charging voltage superimposed on a bias voltage to the rotary belt, to cause a suction force from the rotary belt to the recording medium; and a controller configured to cause a cleaning operation to be performed to the rotary belt only after a print job that includes one page or multiple pages has been completed, the cleaning operation including causing the contact member to be held in contact with the rotary belt, causing the driving mechanism to drive the rotary belt when the contact member is held in contact with the rotary belt, and reducing the bias voltage applied to the rotary belt by the charging mechanism from the charging voltage that causes the suction force from the rotary belt to the recording medium to a reduced voltage that does not cause the suction force from the rotary belt to the recording medium, before performing the cleaning operation.

19. An image forming apparatus which uses an electrostatic force to flatly hold a recording medium during conveyance, comprising:

a rotary belt for carrying a recording medium;

an image forming mechanism configured to perform an image forming operation to form an image on the recording medium carried by the rotary belt;

a driving mechanism configured to drive the rotary belt;

a contact member movably held near the rotary belt;

a charging mechanism configured to apply a charging voltage superimposed on a bias voltage to the rotary belt, to cause a suction force from the rotary belt to the recording medium; and a controller configured to cause a cleaning operation to be performed to the rotary belt, the cleaning operation including causing the contact member to be held in contact with the rotary belt, causing the driving mechanism to drive the rotary belt when the contact member is held in contact with the rotary belt, and reducing the bias voltage applied to the rotary belt by the charging mechanism from the charging voltage that causes the suction force from the rotary belt to the recording medium, to a reduced voltage that does not cause the suction force from the rotary belt to the recording medium, before performing the cleaning operation.

* * * * *